US006111509A

United States Patent [19]

Holmes

[11] Patent Number: 6,111,509

[45] Date of Patent: Aug. 29, 2000

[54] MICROPROCESSOR BASED BED PATIENT MONITOR

[75] Inventor: Fred H. Holmes, Cleveland, Okla.

[73] Assignee: Bed-Check Corporation, Tulsa, Okla.

[21] Appl. No.: 09/031,363

[22] Filed: Feb. 26, 1998

[51] Int. Cl.[7] ..... G08B 23/00

[52] U.S. Cl. ..... 340/573.4; 340/573.1; 340/286.07

[58] Field of Search ..... 340/310.01, 310.06, 340/310.07, 286.06, 286.07, 539, 573.1, 573.4, 692, 552

[56] References Cited

U.S. PATENT DOCUMENTS

| | | | |
|---|---|---|---|
| 4,484,043 | 11/1984 | Musick et al. | 200/85 R |
| 4,565,910 | 1/1986 | Musick et al. | 200/85 R |
| 4,792,990 | 12/1988 | Beyers, Jr. | 455/234.2 |
| 5,224,496 | 7/1993 | Palmer et al. | 340/573.4 |
| 5,481,478 | 1/1996 | Palmiere et al. | 340/310.01 |
| 5,519,380 | 5/1996 | Edwards | 340/573.4 |
| 5,537,459 | 7/1996 | Price et al. | 340/286.07 |
| 5,554,835 | 9/1996 | Newham | 200/85 R |
| 5,781,108 | 7/1998 | Jacob et al. | 340/552 |
| 5,838,223 | 11/1998 | Gallant et al. | 340/286.07 |

FOREIGN PATENT DOCUMENTS

| | | |
|---|---|---|
| 0 191 906 | 8/1986 | European Pat. Off. . |
| WO 95/03596 | 2/1995 | WIPO . |
| WO 95/22363 | 8/1995 | WIPO . |
| WO 96/03727 | 2/1996 | WIPO . |
| WO 97/06519 | 2/1997 | WIPO . |
| WO 98/10391 | 3/1998 | WIPO . |

OTHER PUBLICATIONS

Patent Abstracts of Japan. vol. 097, No. 004, Apr. 30, 1997 & JP 08 322810 A (Nippon Denshi Kogyo KK), Dec. 10, 1996.

Patent Abstracts of Japan. vol. 095, No. 010, Nov. 30, 1995 & JP 07 168990 A (Canon Inc), Jul. 4, 1995.

*Primary Examiner*—Jeffery A. Hofsass
*Assistant Examiner*—Van T. Trieu
*Attorney, Agent, or Firm*—Fellers, Snider, Blakenship, Bailey & Tippens, P.C.

[57] ABSTRACT

A microprocessor based bed patient monitor receives electronic signals from a mat sensing the presence of a patient. The monitor aural alarm system includes a loudspeaker driven by a power amplifier responsive to an input signal derived from a programmable volume control. The processor synthesizes any one of multiple alarm sounds under software control, operates the programmable volume control of the alarm system and activates and deactivates the alarm in response to the electronic signals received from the sensor and a user interface. An electrically erasable programmable read-only memory external to the processor stores a plurality of alarm sounds for selection by the processor for synthesis of the selected alarm sound, stores multiple decibel levels for selection by the processor of the desired decibel level of the alarm sound, permits storage of a plurality of delay time options prior to activation of the alarm by the processor, logs usage data with respect to the monitor including the total hours of use of the monitor, the total time of alarms sounded by the monitor, the total number of alarms sounded by the monitor and the response time between the most recent sounding of an alarm and a subsequent operation of the monitor by the care giver and permits downloading the log usage data to a host computer. A nurse call interface requires no modification to accommodate the type of nurse call station with which the monitor is used.

10 Claims, 17 Drawing Sheets

301
ALARM
303
INITIALIZE FLASH TIMER
305
TURN ON ALARM TURN OFF HOLD
307
RESET PRESSED ?
YES
NO
309
GO TO EXECUTIVE
311
FLASH TIMER EXPIRED ?
YES
NO
313
TOGGLE ALARM LIGHT
315
RESET TIMER
317
WEIGHT RETURN TO MAT ?
YES
NO
319
GO TO MONITOR
321
DELAY TIMER EXPIRED ?
NO
YES
323
A

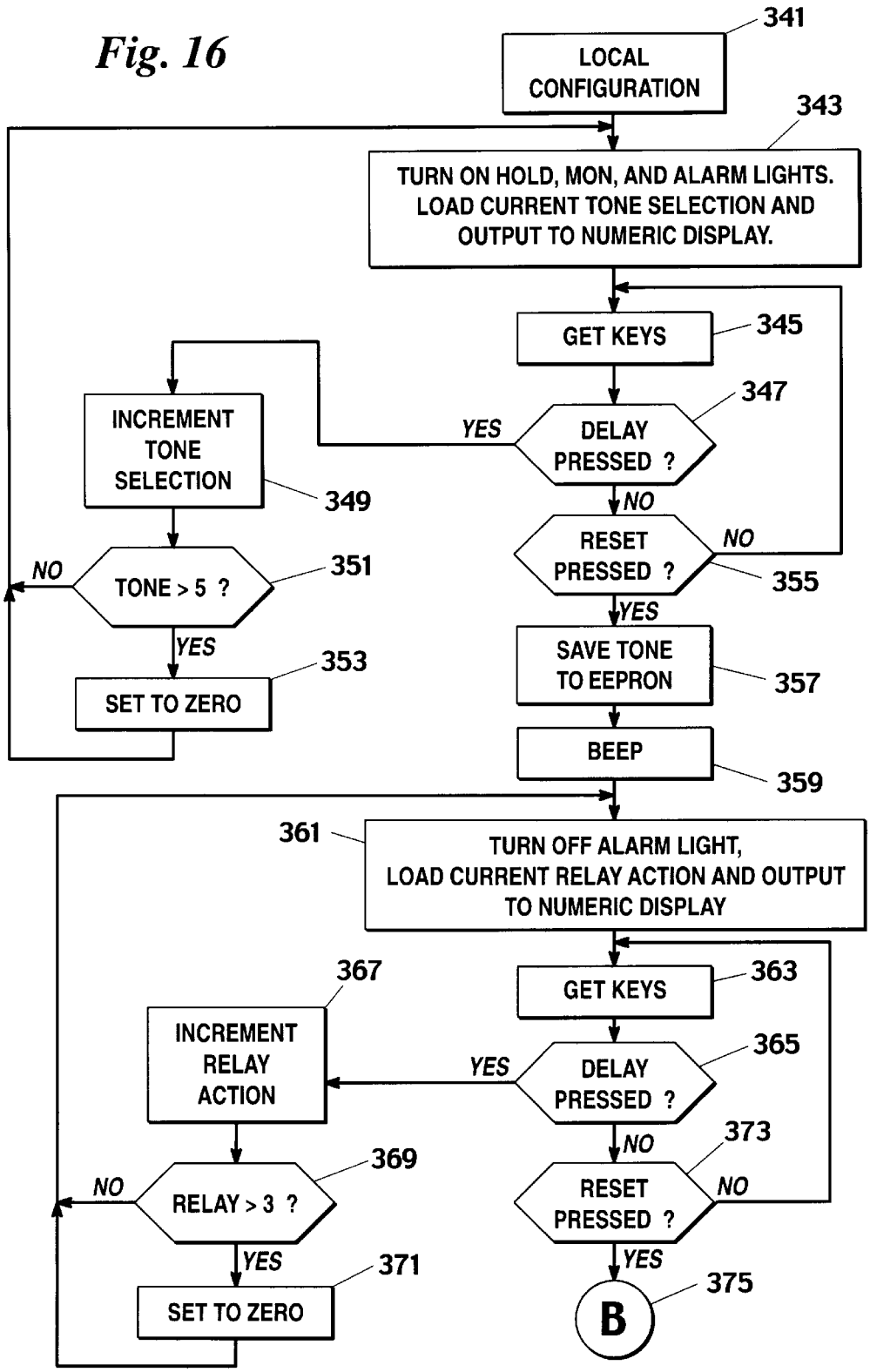
Fig. 16
LOCAL CONFIGURATION
341
343
TURN ON HOLD, MON, AND ALARM LIGHTS. LOAD CURRENT TONE SELECTION AND OUTPUT TO NUMERIC DISPLAY.
GET KEYS
345
347
DELAY PRESSED ?
YES
NO
INCREMENT TONE SELECTION
349
TONE > 5 ?
351
NO
YES
SET TO ZERO
353
RESET PRESSED ?
355
NO
YES
SAVE TONE TO EEPRON
357
BEEP
359
361
TURN OFF ALARM LIGHT, LOAD CURRENT RELAY ACTION AND OUTPUT TO NUMERIC DISPLAY
GET KEYS
363
365
DELAY PRESSED ?
YES
NO
367
INCREMENT RELAY ACTION
369
RELAY > 3 ?
NO
YES
371
SET TO ZERO
373
RESET PRESSED ?
NO
YES
375
B

MICROPROCESSOR BASED BED PATIENT MONITOR

BACKGROUND OF THE INVENTION

This invention relates generally to monitoring systems and more particularly concerns devices used to monitor bed patients in hospital or other care giving environments.

Known bed patient monitors using sensing mats to detect the presence of a patient suffer from a variety of drawbacks.

For one, known bed monitoring systems include externally accessible switches allowing the care giver to reconfigure the monitor circuits such as those circuits which establish the time lapse that must occur between the operation of the sensing mat and the giving of an alarm or the duration of the alarm. External switching makes tampering with the system extremely easy.

A further problem with known bed monitoring systems is that they use oscillating transducers in their audio circuits, resulting in single frequency audio alarms. Since bed monitor alarms are frequently employed in environments in which a multiplicity of other problems also result in audio alarms, if the single alarm sound provided by the bed monitor is similar to one or more other alarm sounds heard in response to different monitors, confusion and consequential inadequate response times to alarms may result.

Another problem with presently known bed monitoring systems is that, while it is frequently desirable to connect the system to a nurse call station, nurse call station configurations differ. It is, therefore, necessary to make internal modifications to the monitor if the nurse call station is not configured in the manner anticipated by the device.

Another failure in known bed monitoring systems is that they do not provide a method of logging statistical data with respect to the operation of the unit and the response times of the care giver to alarm conditions, information that could be very helpful to the maintenance and proper operation of the monitor.

It is, therefore, a primary object of this invention to provide a bed patient monitor that is microprocessor based so as to be reconfigurable by the uploading of configuration data to an electronically erasable programmable read only memory external to the microprocessor. A further object of this invention is to provide a microprocessor based bed patient monitor which synthesizes multiple alarm sounds in software for selection by the care giver. It is also an object of this invention to provide a microprocessor based bed patient monitor having a nurse call interface allowing interconnection with any nurse call station without modification of the monitor. Yet another object of this invention is to provide a microprocessor based bed patient monitor having an electrically erasable programmable read only memory external to the microprocessor for logging statistical data with respect to the use of the monitor and the response time of the care giver using the monitor. Another object of this invention is to provide a microprocessor based bed patient monitor which permits the downloading of the logged statistical data to a host microprocessor connected to the system.

SUMMARY OF THE INVENTION

In accordance with the invention, a bed patient monitor is provided in which a processor receiving electronic signals from a sensor indicating the presence on the sensor and absence from the sensor of a patient is combined with an alarm system which includes a loudspeaker driven by a power amplifier which responds to an input signal derived from a programmable volume control to produce an aural alarm. The processor synthesizes at least one and preferably multiple alarm sounds under software control, operates the programmable volume control of the alarm system to select the decibel level of the alarm and activates and deactivates the alarm in response to the electronic signals received from the sensor and a user interface. An electrically erasable programmable read-only memory external to the processor stores a plurality of alarm sounds for selection by the processor for synthesis of the selected alarm sound. In addition, the electrically erasable programmable read-only memory stores multiple decibel levels for selection by the processor of the desired decibel level of the alarm sound.

Preferably, the electrically erasable programmable read-only memory also permits storage of a plurality of options for the delay time between initiation of the absence of a patient from the sensor and the activation of the alarm by the processor. Furthermore, the monitor is preferably provided with an external switch connected to the processor for care giver selection of the delay time from the plurality of delay time options.

It is also preferred that the electrically erasable programmable read-only memory log usage data with respect to the monitor including the total hours of use of the monitor, the total time of alarms sounded by the monitor, the total number of alarms sounded by the monitor and the response time between the most recent sounding of an alarm and a subsequent operation of the monitor by the care giver. The monitor will include a port for downloading the log usage data to a host computer.

The monitor also includes a nurse call interface having a relay which is energized when the power amplifier is de-energized and which has a normally opened contact, a normally closed contact and a common contact for interconnecting the monitor to a nurse call system to one of the normally opened and normally closed contacts so that the monitor requires no modification to accommodate the type of nurse call station with which the monitor is used.

BRIEF DESCRIPTION OF THE DRAWINGS

Other objects and advantages of the invention will become apparent upon reading the following detailed description and upon reference to the drawings in which:

FIG. 16 is a flow diagram illustrating a portion of a preferred embodiment of the program mode of the monitor;

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
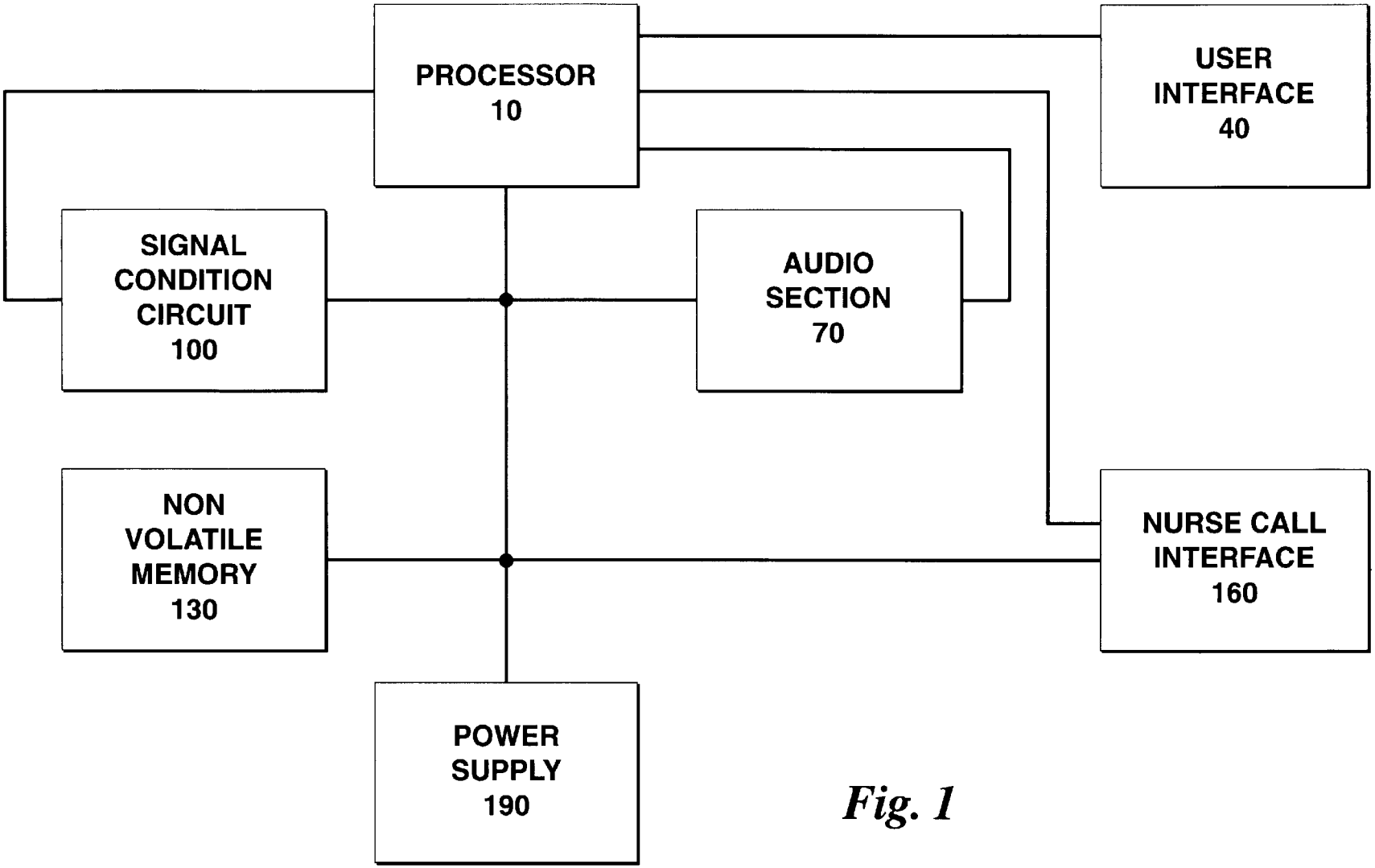
FIG. 1 is a block diagram illustrating a preferred embodiment of the monitor.

A microprocessor based bed patient monitor provides improved functionality in comparison to known control units by introducing added features and improvements in the intuitiveness of the operation. Looking at FIG. 1, a preferred embodiment of the monitor hardware has seven functional blocks including a processor 10, a user interface 40, an audio section 70, a signal conditioning circuit 100, a non-volatile memory 130, a nurse call interface 160 and a power supply 190.

Figure 2:
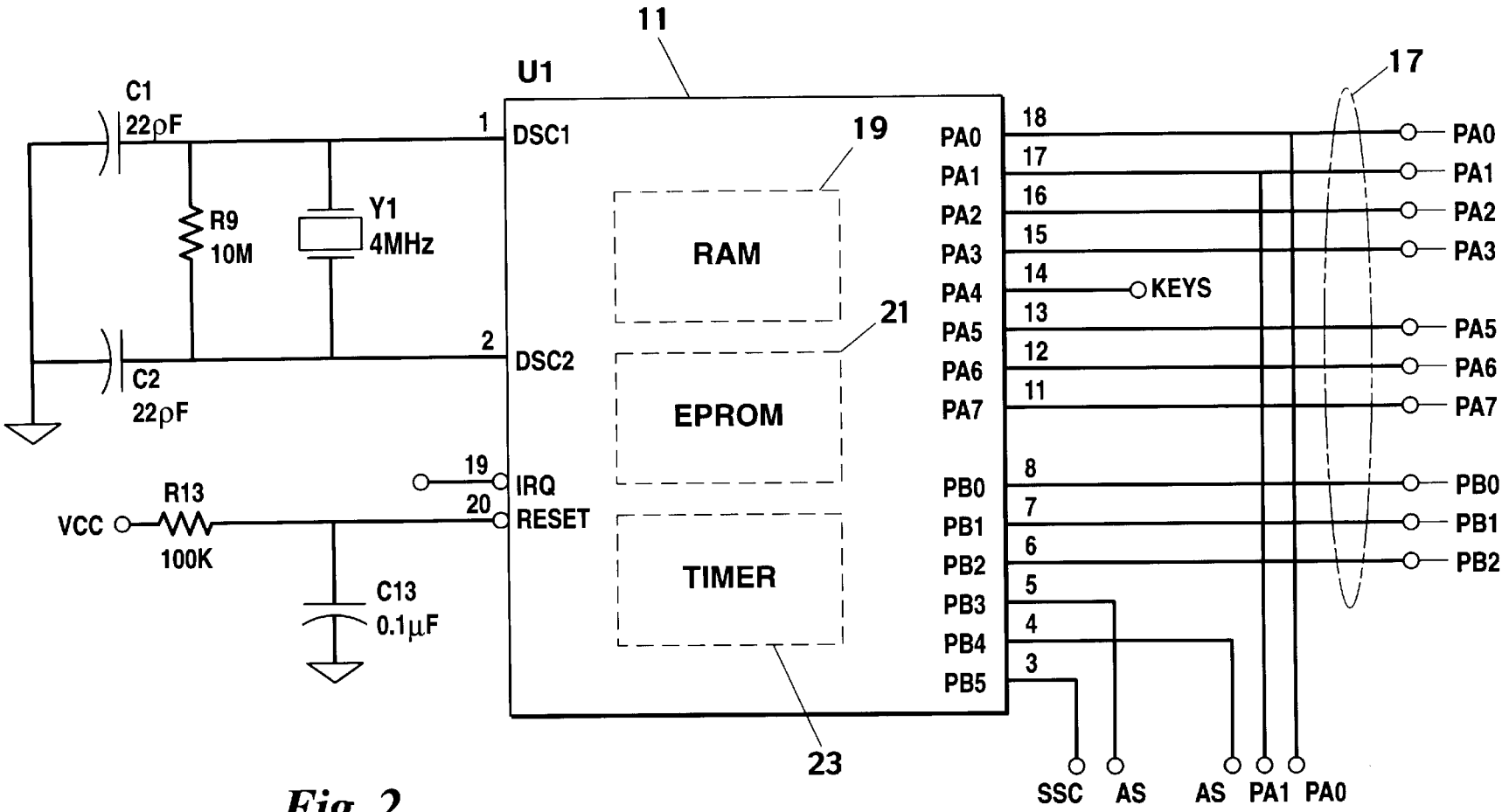
FIG. 2 is a schematic diagram illustrating a portion of a preferred embodiment of the processor of the monitor.
Figure 3:
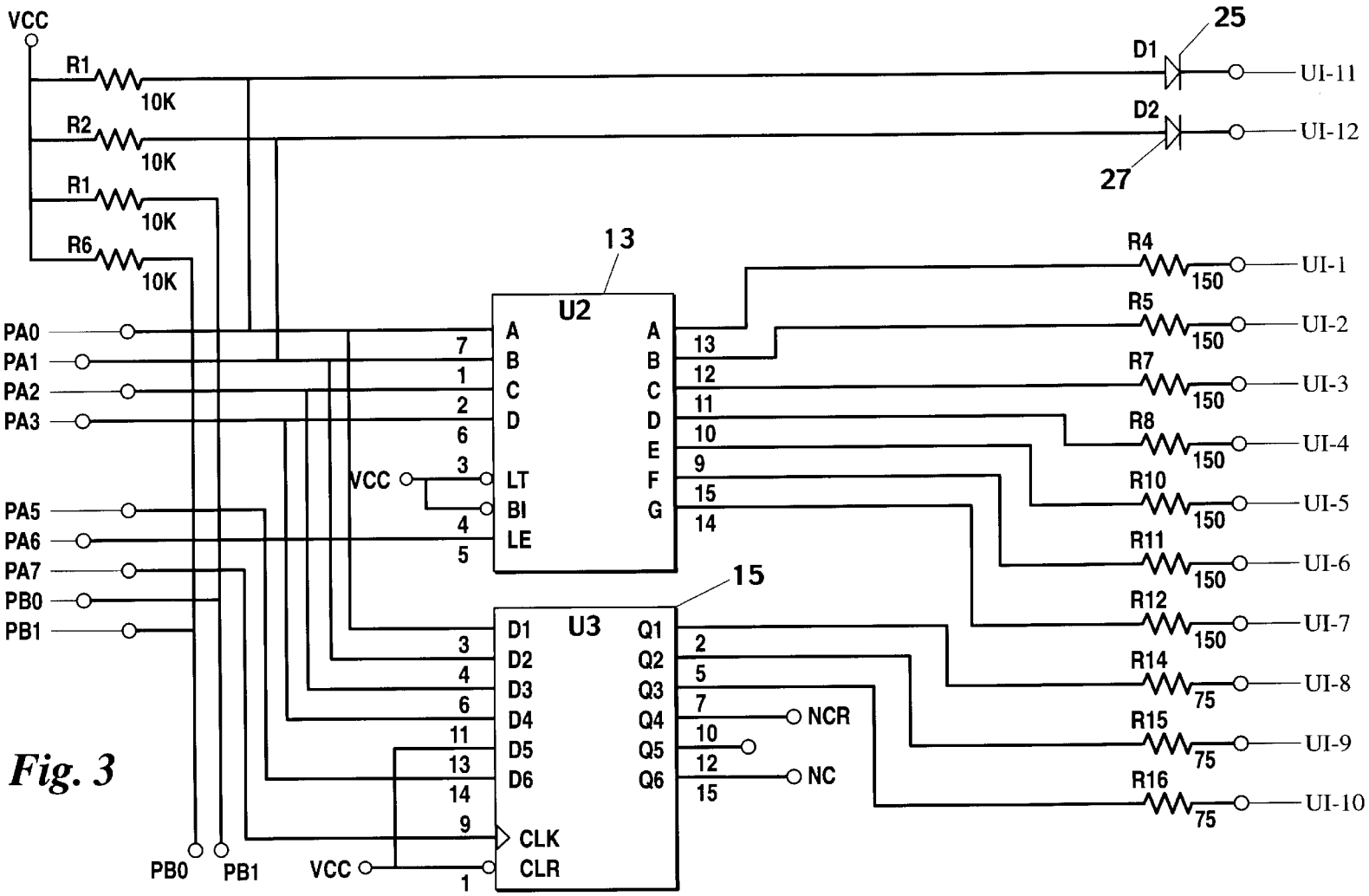
FIG. 3 is a schematic diagram illustrating a portion of a preferred embodiment of the processor of the monitor.

As shown in FIGS. 2 and 3, the processor 10 includes a microcontroller 11, a latching display driver 13 and a latch 15. Since the microcontroller 11 is synthesizing the alarm sound in software, it is important to run the microcontroller 11 at its maximum operating speed. The microcontroller 11 preferably has fourteen general purpose I/O pins grouped into a port A and a port B and one interrupt request input IRQ. The pins of the microcontroller 11 are utilized as follows:

Port A Bit 0: via a multifunction bus 17 to D1 of the latch 15, $A_{IN}$ of the latching display driver 13, INC of a volume control 71 in the audio section 70, via a diode 25 to UI11 of the user interface 40 and via a resistor $R_1$ to VCC;

Port A Bit 1: via the multifunction bus 17 to D2 of the latch 15, $B_{IN}$ of the latching display device 13 and U/D of the volume control 71, via a diode 27 to UI12 of the user interface and via a resistor $R_2$ to VCC;

Port A Bit 2: via the multifunction bus 17 to D3 of the latch 15 and $C_{IN}$ of the latching display driver 13;

Port A Bit 3: via the multifunction bus 17 to D4 of the latch 15 and $D_{IN}$ of the latching display driver 13;

Port A Bit 4: to Key Input Enable of the user interface 40;

Port A Bit 5: via the multifunction bus 17 to D6 of the latch 15;

Port A Bit 6: to LE of the latching display driver 13;

Port A Bit 7: to CLK of the latch 15;

Port B Bit 0: to SDA of the non-volatile memory 130 (EEPROM Data), via a resistor $R_3$ to VCC and the power supply 190;

Port B Bit 1: to SCL of the non volatile memory 130 (EEPROM clock), via a resistor $R_6$ to VCC and the power supply 190;

Port B Bit 2: to the nurse call interface 160 (pull out detection);

Port B Bit 3: to CS of the volume control 71 (volume);

Port B Bit 4: to VH of the volume control 71 (audio out);

Port B Bit 5: to the signal condition circuit 100 (foreign mat detect);

IRQ (Interrupt Request): to the signal condition circuit 100 (mat input);

Reset: to VCC through the time delay $R_{13}/C_{13}$; and

OSCI and OSC2: to the master clock for the microcontroller 11.

The remaining pins of the latching display driver 13 are used as follows:

$A_{OUT}$: Via a resistor $R_4$ to UI1 of the user interface 40;
$B_{OUT}$: Via a resistor $R_5$ to UI2 of the user interface 40;
$C_{OUT}$: Via a resistor $R_7$ to UI3 of the user interface 40;
$D_{OUT}$: Via a resistor $R_8$ to UI4 of the user interface 40;
$E_{OUT}$: Via a resistor $R_{10}$ to UI5 of the user interface 40;
$F_{OUT}$: Via a resistor $R_{11}$ to UI6 of the user interface 40;
$G_{OUT}$: Via a resistor $R_{12}$ to UI7 of the user interface 40; and
LT and B1: to VCC The remaining pins of the latch 15 are used as follows:

$Q_1$: via a resistor $R_{14}$ to UI8 of the user interface 40;
$Q_2$: via a resistor $R_{15}$ to UI9 of the user interface 40;
$Q_3$: via a resistor $R_{16}$ to UI10 of the user interface 40;
$Q_4$: to the nurse call interface 160;
$Q_5$: unused;
$Q_6$: to the nurse call interface 160; and
D5 and CLR: to VCC.

The multifunction bus 17 to D1, 2, 3, 4 and 6 of the latch 15 capitalizes on the bidirectional feature of the microcontroller 11 to create a local data bus. This allows the associated pins PA0, 1, 2, 3 and 5 of the microcontroller 11 to be used for several functions, reducing the total number of I/O pins required and allowing for a smaller, less expensive microcontroller 11 to be used. The multifunction bus 17 sources information for a numeric display 41 via the latching display driver 13, selects annunciators 43 to be illuminated via the latch 15, energizes the nurse call relay K1 via the latch 15, provides up/down information for the programmable volume control 71 and inputs the status of the keypad 45. Operation of the multifunction bus 17 is purely under software control. The microcontroller 11 contains internal RAM 19, EPROM 21, and a Timer 23. Preferably, the microcontroller 11 is a Motorola MC68HC705J2, the latching display driver 13 is a Motorola 74HC4511 and the latch 15 is a Motorola 74HC174.

A resistor $R_{13}$ and capacitor $C_{13}$ connected between the power source VCC and the RESET port of the microcontroller 11 provide time delay at initialization and a typical clock circuit is connected to the OSC1 and OSC2 ports of the microcontroller 11.

Figure 4:
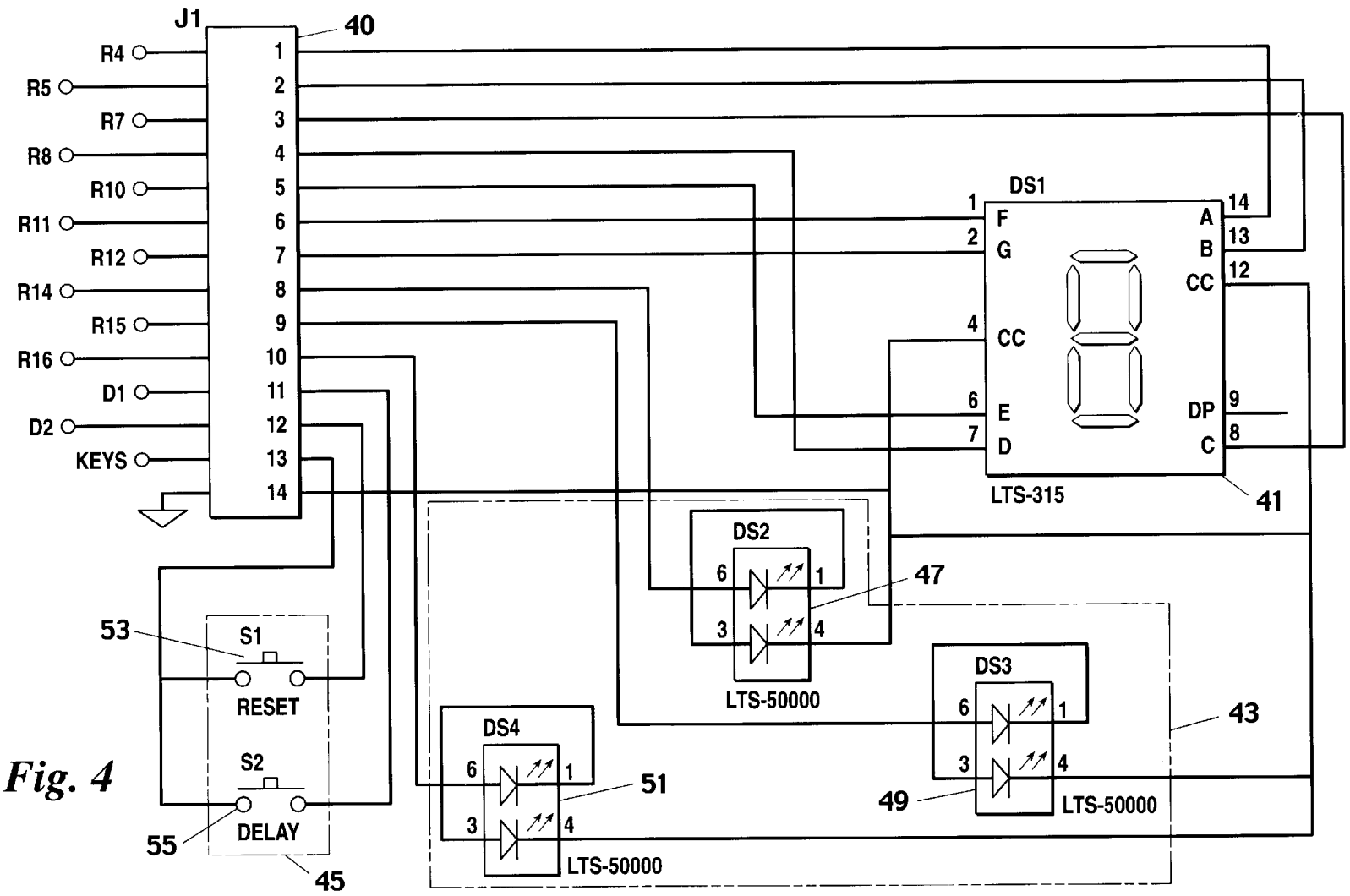
FIG. 4 is a schematic diagram illustrating a preferred embodiment of the user interface of the monitor.

Turning to FIG. 4, the user interface 40 consists of the numeric display 41, an annunciator bank 43 including a HOLD annunciator 47, a MON annunciator 49 and an ALARM annunciator 51 and the keypad 45 including a reset switch 53 and a delay adjust switch 55. The numeric display 41 is a seven segment display driven by the latching display driver 13. The preferred latching display driver 13, such as the Motorola 74HC4511, takes Binary Coded Decimal (BCD) in and decodes it into the appropriate segments to display the desired number. The BCD input is provided by D1–D4 of the multifunction bus 17. The information is latched into the latching display driver 13 by Port A Bit 6. The latching operation frees up the multifunction bus 17 for other purposes while maintaining a stable display. The latching display driver 13 provides a blanking function, a totally dark display, by writing a number greater than nine to the BCD input. Four bits of data provide 16 possible combinations (0–15), while only ten combinations are defined in BCD (0–9). The other six combinations (10–15) result in turning off all of the display segments. The numeric display 41 is used to display the seconds of delay which precede an alarm in normal operation of the monitor. In addition, the display 41 is used to show selected options during the local programming mode, as is hereinafter further described in relation to the monitor software. All three annunciators, 43, 45 and 47, are LED's driven by the latching display driver 13. The preferred latching display driver 13, a Motorola 74HC4511, is capable of sourcing 20 milliamps per output 50. No additional drive is necessary to each LED. The driver 13 has a hex latch (six individual D flip/flops with a common clock line). Only five latch outputs are implemented and one of those is unused in the current software. Q1 through Q3 are used for the annunciators 47, 49 and 51, respectively. By using a latch 15 with sufficient drive capability, the latching display driver 13 provides the source current to illuminate each LED and also latches the data so that the annunciators 43, 45 and 47 remain stable while the multifunction bus 17 is used for other purposes. To turn on a particular annunciator 47, 49 or 51, the processor 10 raises the appropriate bit of the multifunction bus 17, D1 for ALARM 47, D2 for MON 49 or D3 for HOLD 51, and then toggles Port A Bit 7 to latch the data. Operating characteristics for each mode are hereinafter described in relation to the monitor software. The reset switch 53 and delay adjust switch 55 are inputted to the processor 10 on bits D1 and D2 of the multifunction bus 17. The two switches 53 and 55 share a common select line so a read of either switch 53 or 55 always reads both switches 53 and 55. To accomplish a read, the processor 10 must make Port A Bit 0 and Port A Bit 1 inputs. The switches 53 and 55 are then read by taking Port A Bit 4 low. The two inputs are pulled up by resistors $R_1$ and $R_2$ and these two bits may be pulled low through diodes $D_1$ and $D_2$ respectively. This can only happen if the appropriate switch 53 or 55 is closed and the key enable line is low.

Figure 5:
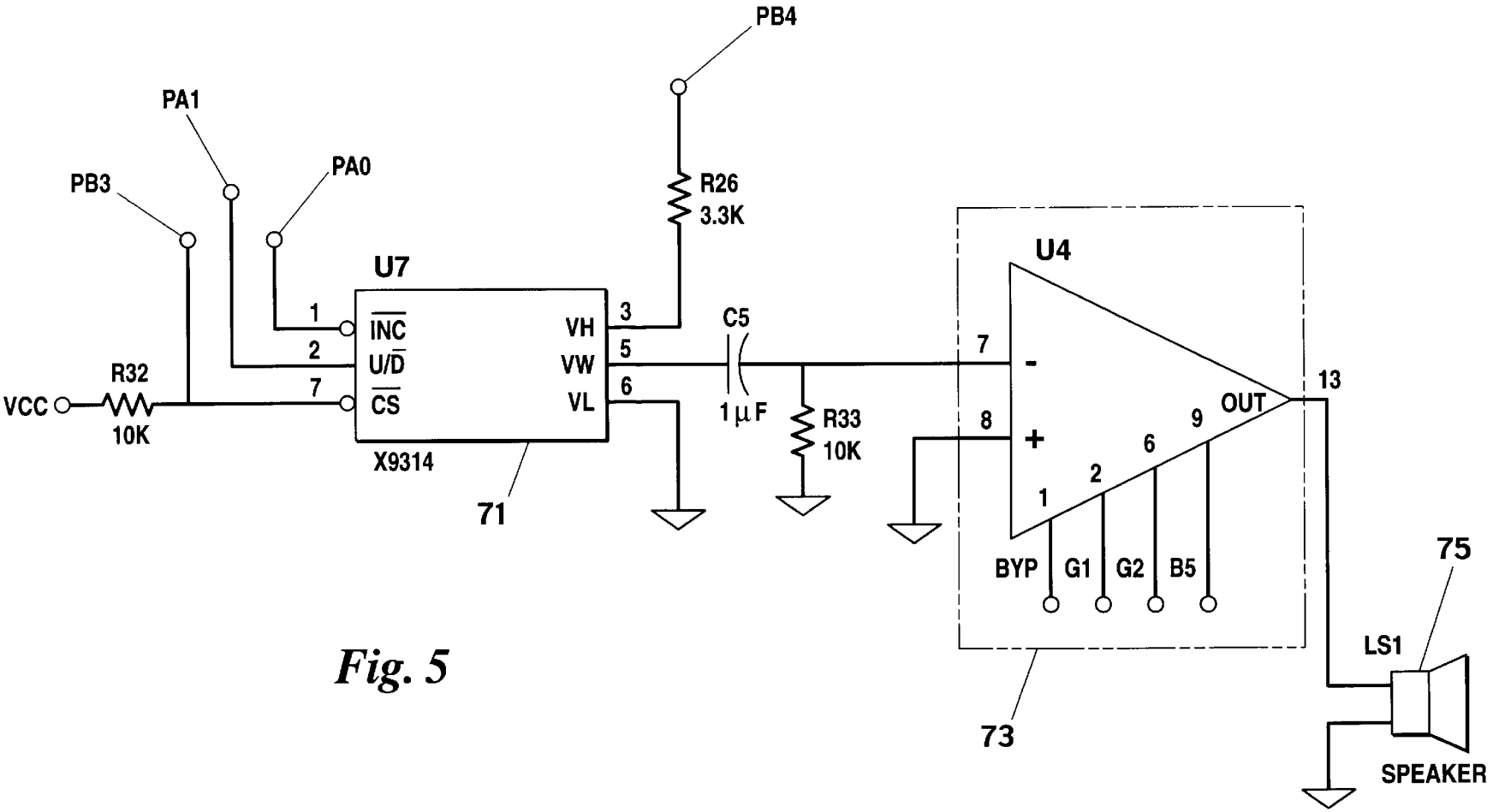
FIG. 5 is a schematic diagram illustrating a preferred embodiment of the audio section of the monitor.

Looking now at FIG. 5, the audio section 70 consists of a programmable volume control 71, a power amplifier 73 and a loudspeaker 75. The audio is a single bit square wave generated by the processor 10 under software control. The audio signal is divided to the requested volume by the programmable volume control 71, the power amplified to a sufficient level to drive the loudspeaker 75 and converted to audio by the loudspeaker 75. The volume control 71 is preferably a Xicor Corporation X9314 digital potentiometer. This integrated circuit performs the same function as a potentiometer except the wiper position VW is digitally positioned to any one of 32 (0–31) possible steps. The circuit is designed such that position zero is minimum volume (no sound) and position 31 is maximum volume. To control the volume chip select CS, which is connected to VCC via a pull-up resistor $R_{32}$, is set low (Port B Bit 3), the up-down pin U/D (mfb D1) is set low to reduce volume or high to increase volume, and the increment-decrement INC pin (mfb D0) is toggled the appropriate number of times to reach the new wiper position. The multifunction bus 17 is used for the U/D control and for the INC control since these signals have no effect on the chip in the absence of a valid chip select signal. Therefore, using mfb D1 and mfb D2 will not effect the volume when used for other purposes and the chip select signal (active low) is high. The output of the programmable volume control 71 is AC coupled by a resistor $R_{33}$ and capacitor $C_5$ and directed to the input of the audio power amplifier 73. The power amplifier is preferably a National Semiconductor LM388 audio amplifier which has adequate drive for the required volume levels and requires relatively few discrete components to produce a viable audio amplifier. It is used in its simplest configuration and directly drives the unit's loudspeaker 75. It has a fixed gain of 20 and a resistor $R_{26}$ scales the audio appropriately for the desired maximum output level. The loudspeaker 75 is a simple two inch polycone speaker.

Figure 6:
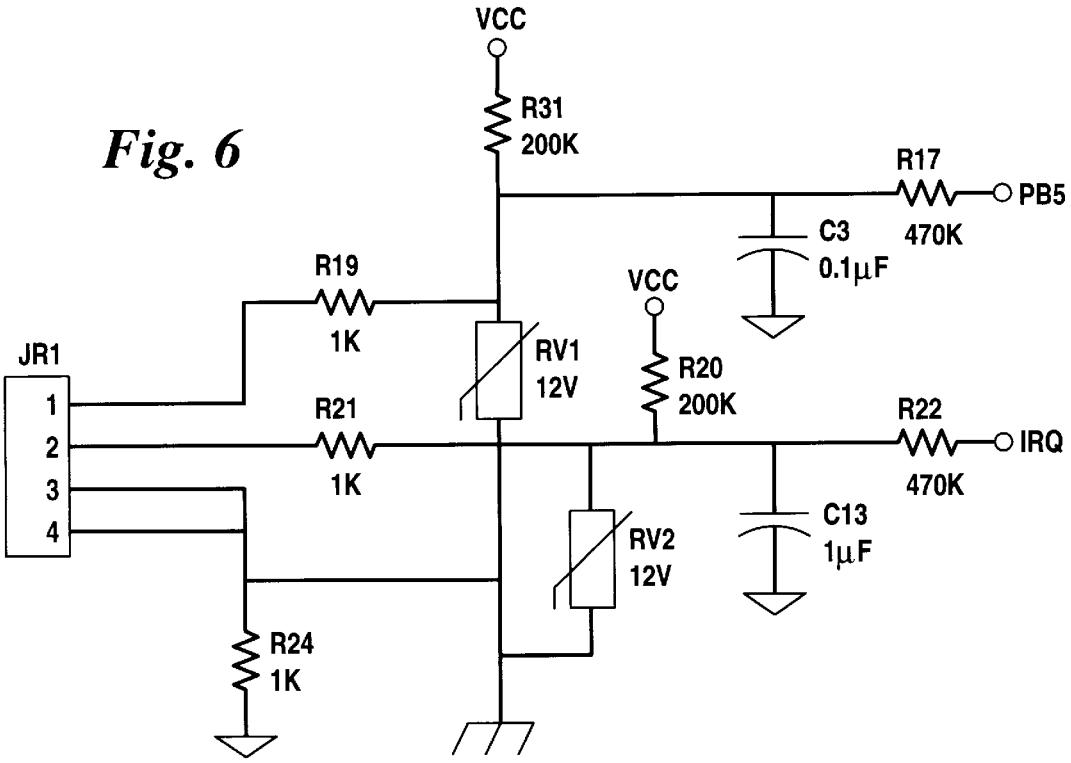
FIG. 6 is a schematic diagram illustrating a preferred embodiment of the signal condition circuit of the monitor.

The signal conditioning circuit 100, shown in detail in FIG. 6, filters noise from the mat inputs JR1-1 and 2 and provides a reasonable degree of protection to the monitor from static discharge. Filtering at one input JR1-2 is accomplished by a single RC circuit including resistors $R_{20}$ and $R_{21}$ and a capacitor $C_6$ and at the other input JR1-1 by a simple RC circuit including resistors $R_{19}$ and $R_{31}$ and a capacitor $C_3$. This eliminates some noise and assists in increasing the immunity from static discharge. A static discharge to the monitor passes through the RC filters and is then clamped at approximately twelve volts by metal oxide varistors $RV_1$ and $RV_2$. The combination of the first input components $R_{20}$, $R_{21}$, $C_6$ and $RV_2$ and the second input components $R_{19}$, $R_{31}$, $C_3$ and $RV_1$ should provide static protection far in excess of known monitors.

Figure 7:
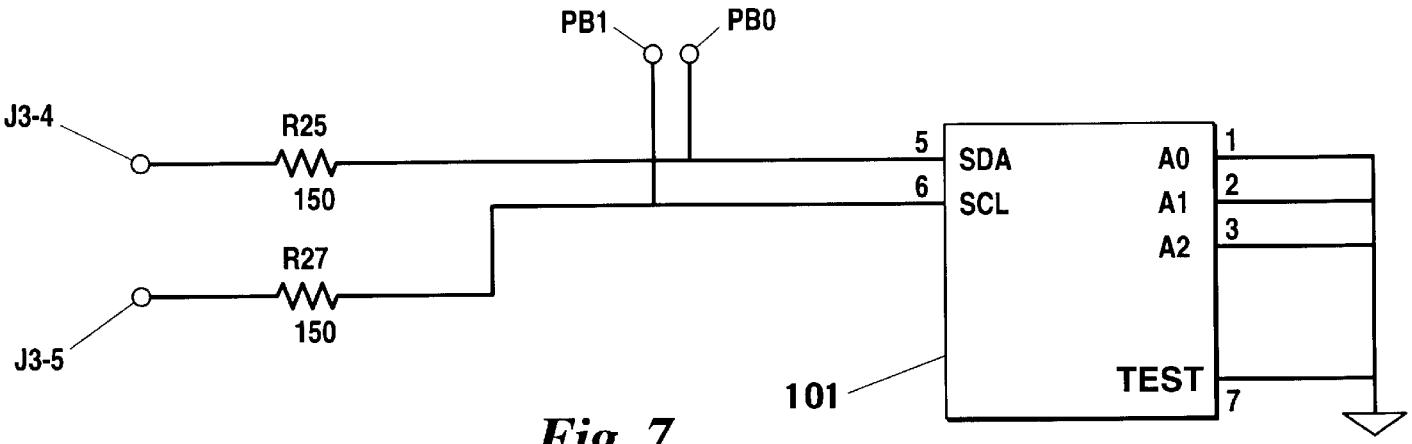
FIG. 7 is a schematic diagram illustrating a preferred embodiment of the nonvolatile memory of the monitor.

The nonvolatile memory 130 illustrated in FIG. 7 includes a 1 Kbit (128×8) electrically erasable programmable read only memory EEPROM 101. It is connected via resistors $R_{25}$ and $R_{27}$ to the power supply interface connections J3-4 and J3-5. The actual IC chip is preferably a Microchip X24LC01 which uses a two wire serial interface to communicate with the processor 10. The interface is based on the IIC bus which has become the predominant standard for low cost inter-chip communication. Detailed information on the chip and the IIC bus may be found in the Microchip Nonvolatile Memory Products databook. The EEPROM 101 is used to store operating characteristics, usages information and device specific information such as a repair log and unit serial number. The operating characteristics are user modifiable variables which control the tone option, the relay action, the hold time delay, and the volume of the alarms. These memory locations may be modified by either the local programming mode as hereinafter described in relation to the monitor software or via a processor interface which connects to a parallel printer port. Usage information consists of an hour meter which logs total hours of use, the total time alarming, the total number of alarms, and the response time to the last alarm. A download of this information allows the additional statistic of "average time to respond" to be calculated. This information may only be written by the monitor, and read only to an inquiring host computer. Read only status is purely a software function of the host. Device specific information is not used by the monitor and is never written or read by the monitor. It is written at the time of manufacture or time of repair by an external host computer. The information is intended for use by the factory, a repair station, or a facilities biomedical staff. This information includes the date of the last ten repairs and work order numbers and the unit's serial number.

Figure 8:
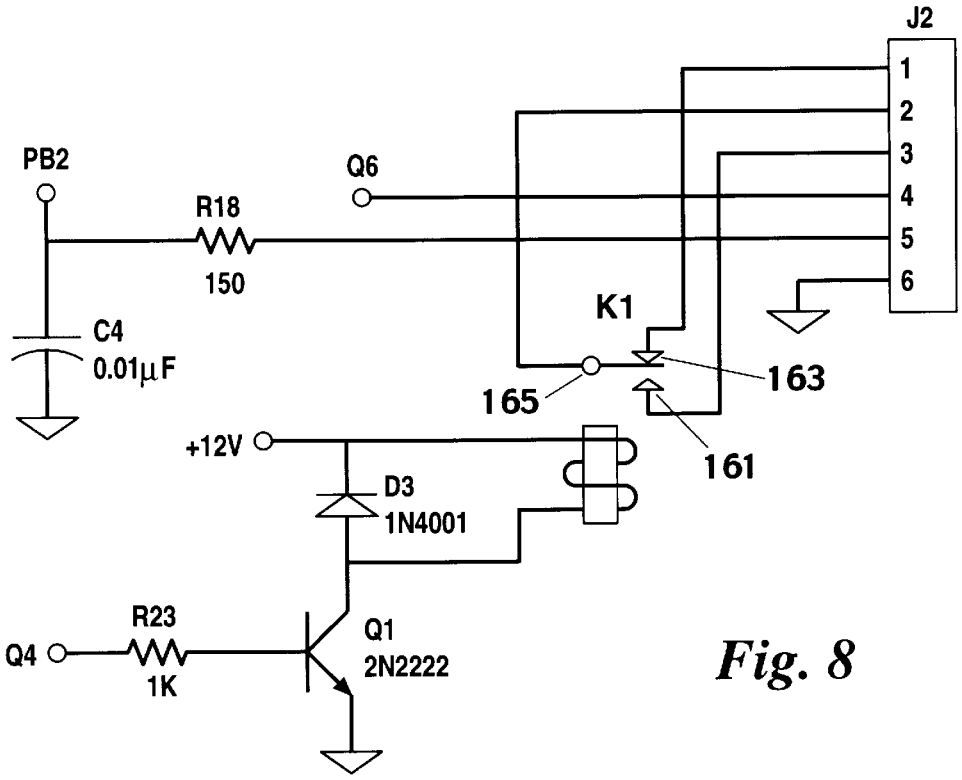
FIG. 8 is a schematic diagram illustrating a preferred embodiment of the nurse call interface of the monitor.

Turning to FIG. 8, the nurse call interface 160 uses a relay K1 to provide isolation between the monitor circuitry and the nurse call system. A normally open contact 161, a normally closed contact 163 and a common contact 165 of the relay K1 are connected to a connector J2. The nurse call cord (not shown) plugs into this connector J2. Since there is always a potential for inadvertent disconnection of a connector J2, two additional pins J2-4 and 5 are used in the connector J2 to provide a continuity loop. By monitoring this loop, the processor 10 can detect a pulled-out nurse call cord. If this condition is detected, a distinct in-room alarm is sounded. Pull-out protection may be disabled via the profile stored in the nonvolatile memory 130 when the system is used in a facility without a nurse call system or in a home. The relay K1 is energized in the non-alarming state. This effectively reverses the contacts 161 and 163 so that the normally open contact 161 appears to be normally closed and vice versa. Thus, a nurse call is issued whenever power is interrupted to the monitor. This provides a fail safe on the power supply 190 and its interconnects. A single RC filter consisting of a resistor $R_{18}$ and a capacitor $C_4$ provides static protection for the processor 10. The relay K1 is turned on by the transistor Q1 via a current limiting resistor $R_{23}$ and a diode $D_3$ absorbs the inductive kick which occurs when the relay K1 is de-energized.

Figure 9:
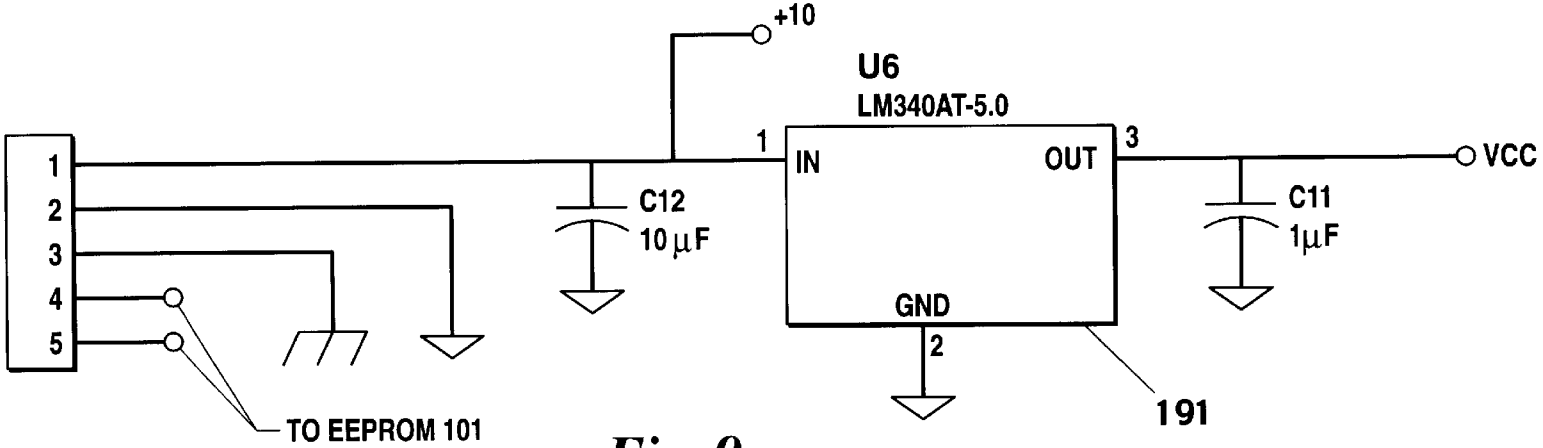
FIG. 9 is a schematic diagram of a preferred embodiment of the power supply of the monitor.

As shown in FIG. 9, the power supply 190 includes an external connector J3. The connector J3 includes a transformer (not shown) connected between two pins J3-1 and J3-2 of the connector. Power VCC is brought into the monitor through a voltage regulator 191 connected to the first connector pin J3-1. Two additional pins J3-4 and 5 of this connector J3 are used for the read/write interface of the external EEPROM 101. Filter capacitors $C_{11}$ and $C_{12}$ are connected on either side of the voltage regulator 191.

The software for the monitor performs a variety of functions. The user interface 40 includes inputs allowing a user to modify control unit actions via the reset button 53 and to adjust the delay via the delay adjust button 55 and outputs for controlling operation of the 0 through 9 numeric display 41, the status annunciators 43 and various aural signals. An idle mode (HOLD), which is active when the monitor is not monitoring, enables automatic advancement to the monitor mode, manual override for immediate advancement to the monitor mode, adjustment of the delay time, aural indications of any unsafe conditions and logging of hours in use. The monitor mode (MON) enables monitoring of the patient for activity within the bed which could be a precursor for a bed evacuation, adjustment of the delay time, manual return to the idle mode (HOLD), automatic advancement to the alarm mode (ALARM), aural indications of any unsafe hardware conditions and logging of hours in use. The alarm mode (ALARM) enables generation of a nurse call through the nurse call system 160, aural in-room alarm, manual return to the idle mode (HOLD) and logging of response time and total alarm time. A program mode enables user customization of features and update of the non-volatile memory 130 with user programming.

All functions which utilize the user interface 40 are consistent with the nomenclature on the buttons 53 and 55 and on the numeric display 41. Any features which use the reset button 53 have an intuitive connection to the word "reset". Likewise, the delay adjust button 55, which features a triangle pointing up, causes an upward adjustment in the numeric display 41 with appropriate roll over at a maximum value.

Figure 10:
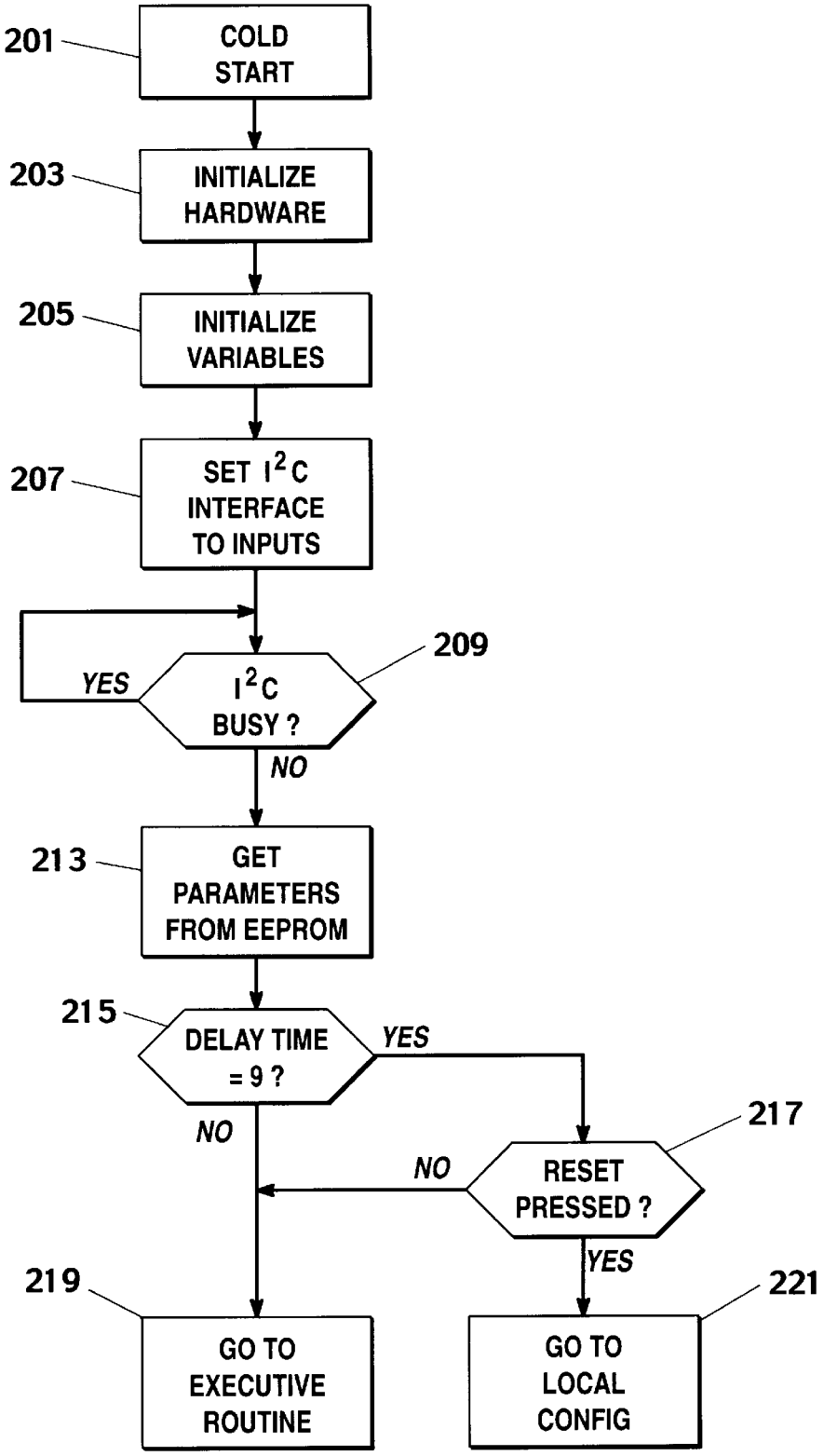
FIG. 10 is a flow diagram illustrating a preferred embodiment of a cold start routine of the monitor.

Looking at FIG. 10, entry into the HOLD mode is made at a cold start 201 of the processor 10. In this software loop, the system will initialize hardware 203 and initialize variables 205. It will then set $1^2C$ interface to inputs 207 to determine whether the interface is already being used, for example to change the programs in the EEPROM 101. An inquiry is then made as to whether the $1^2C$ is busy 209. If the response to this inquiry is "YES," then the inquiry is repeated until the response is "NO." If a "NO" response is received, the system proceeds to get parameters from EEPROM 213. The system will next inquire as to whether the delay time equals nine 215. If the response to this inquiry is "YES," the system will next inquire as to whether the reset is pressed 217. If the response to either the inquiry as to whether the delay time equals nine 215 or whether the reset is pressed 217 is "NO," then the system proceeds to go to executive routine 219. If the response to the inquiry as to whether the reset is pressed 217 is "YES," the system proceeds to go to local configuration 221.

Figure 11:
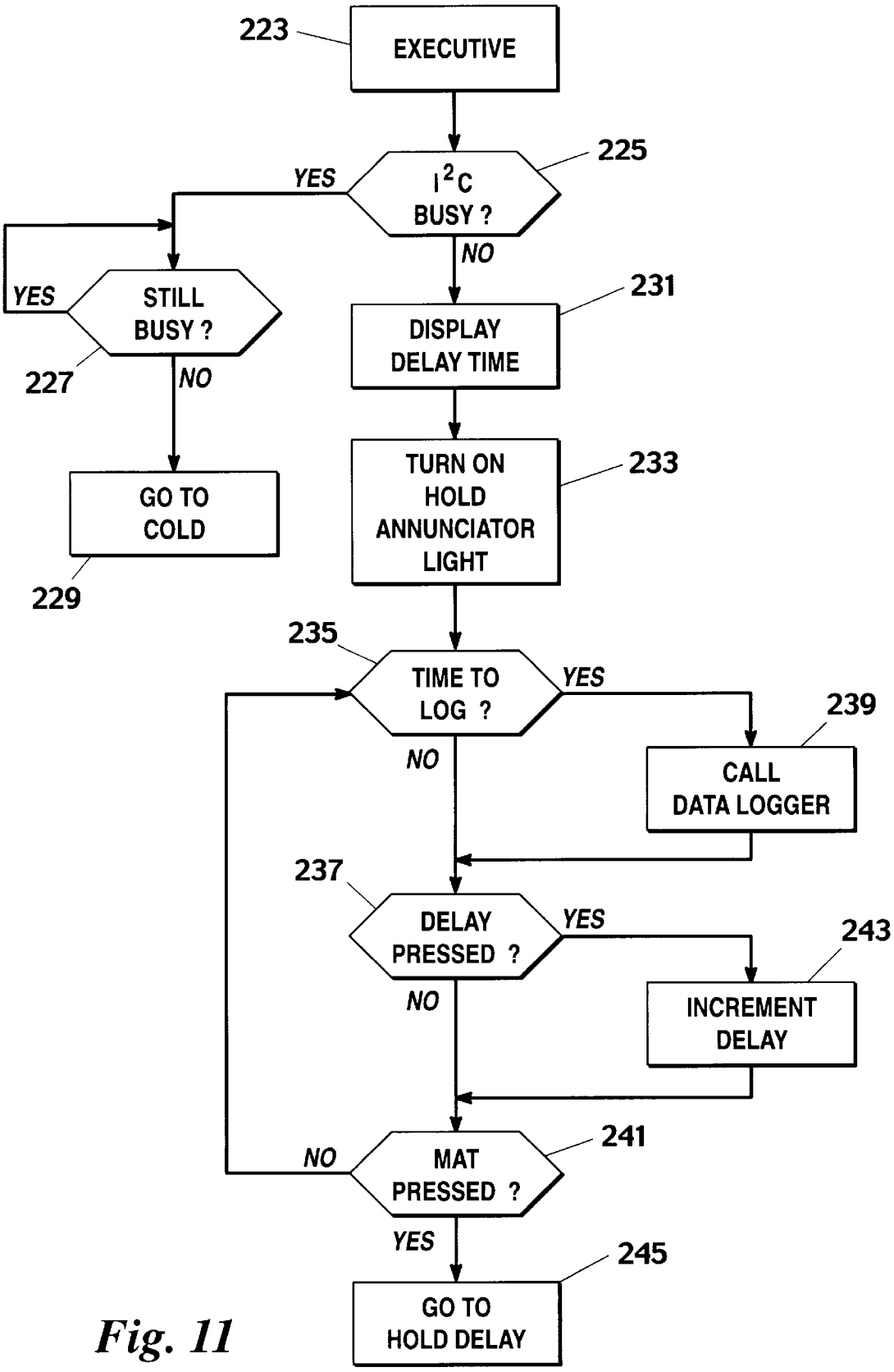
FIG. 11 is a flow diagram illustrating a preferred embodiment of the executive routine of the monitor.

Looking now at FIG. 11, if the system has gone to executive 223, the system will again inquire as to whether the $1^2C$ is busy 225. If the response to this inquiry is "YES," the system will continue to inquire as to whether the $1^2C$ bus is still busy 227. As long as the response to this inquiry is "YES," the inquiry continues. If the response to the inquiry as to whether the $1^2C$ bus is still busy 227 is "NO," then the system will go to cold 229 and resume from the cold start 201 as shown in FIG. 10. If, however, on inquiry as to whether $1^2C$ is busy 225 the response is "NO," the system proceeds to display delay time 231 on the display 41 and will turn on hold annunciator light 233 which is an indication to the care giver that there is no weight on the mat used to monitor the patient's presence. The system then inquires as to whether it is time to log 235. Every six minutes or 1/10th of an hour the system will log the lapse of an increment so as to maintain a record of total hours of use of the monitor. If six minutes has not elapsed, the response to the inquiry is "NO" and the system proceeds to inquire as to whether the delay adjust switch is pressed 237. If six minutes has elapsed, the response to the inquiry as to whether it is time to log 235 is "YES" and the system will proceed to call data logger 239 so as to register this increment. The system then continues to the delay adjust switch pressed inquiry 237 until another six minute interval has elapsed and the call data logger 239 is again cycled. If the response to the inquiry as to whether the delay adjust switch is pressed 237 is "NO," the system proceeds to inquire as to whether the mat is pressed 241. If the response to the inquiry as to whether the delay adjust switch is pressed 237 is "YES," the system proceeds to increment delay 243 by stepping to the next of the nine increments available for delay as hereinbefore discussed and then inquires as to whether the mat is pressed 241. If the response to the mat pressed inquiry 241 is "NO," the system will recycle to the time to log inquiry 235 and continue the process until the response to the mat pressed inquiry 241 is "YES," indicating that a patient is on the sensing mat. If the response to this inquiry is "YES," the system then proceeds to go to hold delay 245.

Figure 12:
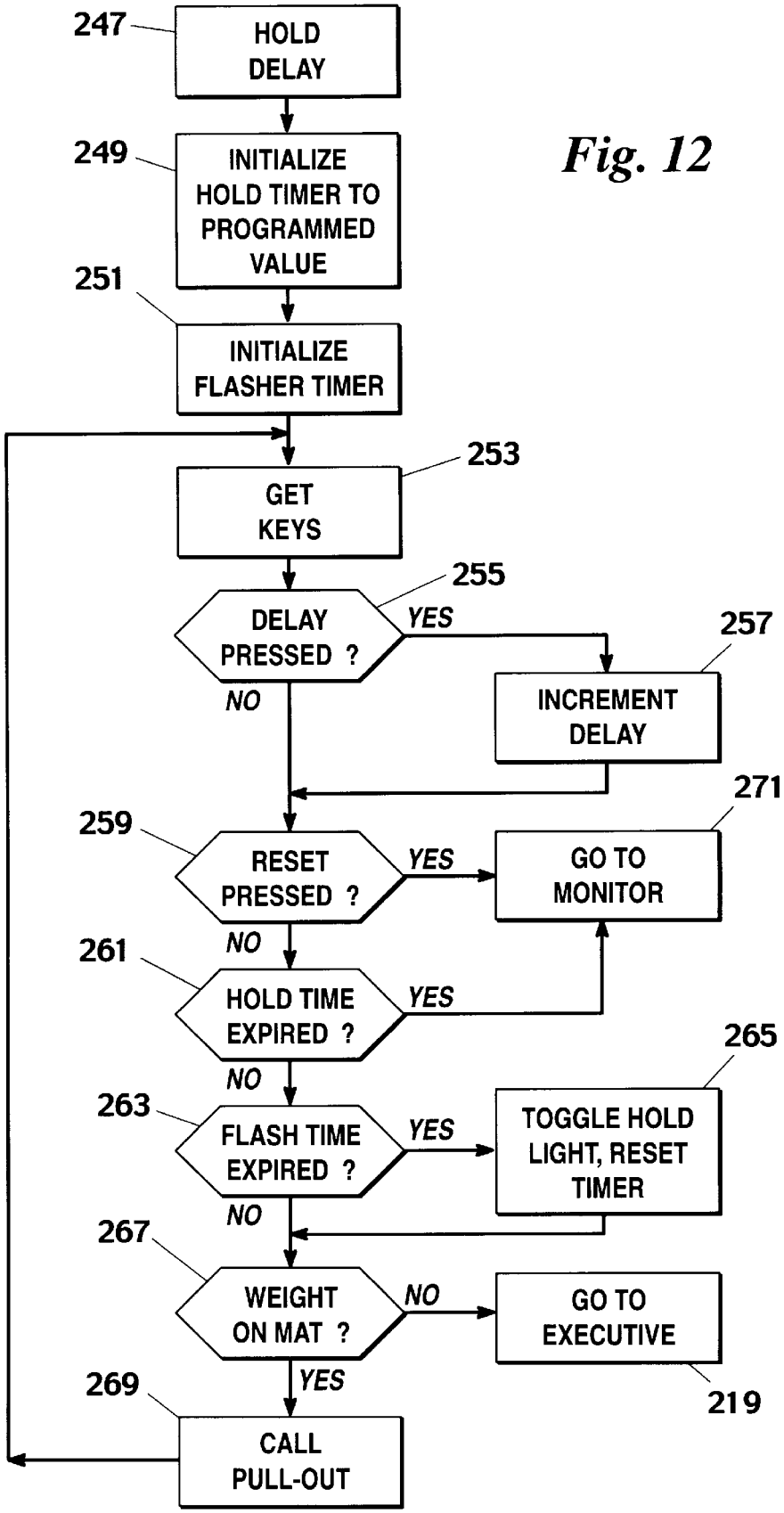
FIG. 12 is a flow diagram illustrating a preferred embodiment of the hold mode routine of the monitor.

Turning now to FIG. 12, representing the transient condition between the hold mode 201 and the monitor mode 273, when the monitor is at hold delay 247, the system will initialize hold timer to program value 249. Generally, the hold timer will permit selection by the caregiver of from 1 to 20 seconds as the interval that the patient's weight must be on the sensing mat before monitoring of the patient's presence is initiated. In the preferred embodiment described herein, this available time interval is in a range of 1 to 9 seconds. The system then proceeds to initialize flasher timer 251. The flasher timer establishes the flash interval for the attenuator indicating that a patient's weight is on the sensing mat. With the timers initialized, the system proceeds to get keys 253 by examining the switches 53 and 55 of the keypad 45. Inquiry is first made as to whether the caregiver has operated the delay adjust 255. A "YES" response indicating that the delay adjust switch 55 is depressed will result in an increment change 257. If the response to the delay adjust inquiry 255 is "NO" or the increment change 257 is made, the system continues on to inquire as to whether the reset is pressed 259. If the response to this inquiry is "NO," the system proceeds to inquire as to whether the hold time is expired 261. If the response to this inquiry is "NO," the system inquires as to whether the flash time has expired 263. If the flash time has expired, providing a YES response, the system will toggle the hold light and reset the timer 265. If the flash time has not expired or has been reset, the system will proceed to inquire as to whether there is a weight on the mat 267. If the response to this inquiry is "NO," the system will go to executive 219, returning to the loop illustrated in FIG. 11. If the response to the weight on mat inquiry 267 is "YES," the system will perform a pullout check 269 to determine if there is an improper connection in the system. After performing the pullout check 269, the system will return to the get keys step 253 of the hold delay loop 247. If, in the operation of the hold delay loop 247, the response to the reset pressed inquiry 259 or the hold time expired inquiry 261 is "YES," then the system will go to monitor 271, as will hereinafter be described.

The HOLD mode 235 is characterized by a continuous hold indicator 47 and the number of seconds of delay time is displayed on the numeric display 41. The nurse call relay K1 is energized (non-alarming state). There is no testing of the sensor validation input, there is no pull-out detection, and the keypad 45 is monitored at least 20 times per second except during tone generation. Upon pressing the delay adjust button 55, the delay is bumped by one second and the display 41 is updated with the new delay time. After nine seconds, the delay time resets to one second. If the reset button 53 is pressed, a ½ second tone at 1 kHz is generated. Software exits this loop and enters the pre-monitor phase of the monitor mode MON when weight is detected on the mat (/IRQ goes low). During the hold mode HOLD, logging of hours in use occurs every 1/10th of an hour (six minutes).

Figure 13:
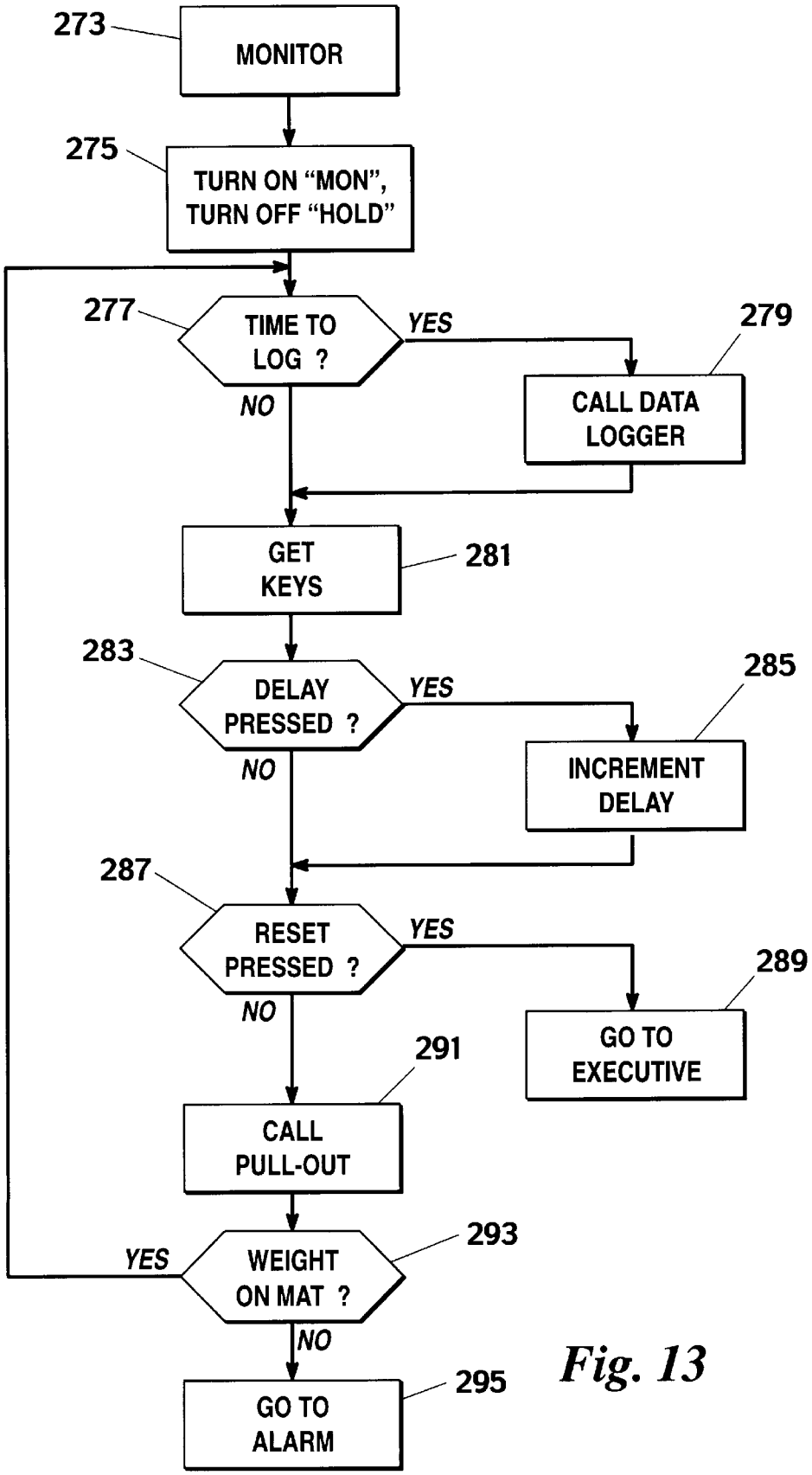
FIG. 13 is a flow diagram illustrating a preferred embodiment of the monitor routine of the monitor.

The monitor routine is illustrated in FIG. 13. When the system goes to monitor 273, it will change the annunciator condition by turning on MON and turning off HOLD 275. Thus, the HOLD annunciator 47 will be de-energized and the monitor annunciator 49 energized. The system will then inquire as to whether it is time to log 277, as has been hereinbefore explained. If the response to this inquiry is "YES," then the system will call data logger 279 to log the expiration of the six minute increment. If the answer to the inquiry as to time to log 277 is "NO," or if an increment has been logged, the system will proceed to a get keys status 281. The system will inquire as to whether the delay adjust switch is pressed 283. If the response to this inquiry is "YES," an increment change 285 will be made in the time delay. If the response to the delay adjust inquiry 283 is "NO" or the increment change 285 has been made, the system will proceed to inquire as to whether the reset is pressed 287. If the response to this inquiry is "YES," the system will go to executive 289 and perform the loop illustrated in FIG. 11. If the response to the reset pressed inquiry 287 is "NO," the system will proceed to call pull-out 291 to determine whether there is an electrical connection failure in the system. The system then inquires as to whether there is a weight on the mat 293. If the response to this inquiry is "YES," the system will return to the time to log step 277 of the monitor loop 273. If the response to the inquiry as to weight on the mat 293 is "NO," the system will proceed to go to alarm 295.

The monitor mode 273 has a transient pre-monitor phase shown in FIG. 12 and a steady-state monitor phase shown in FIG. 13. The pre-monitor state is characterized by a flashing hold indicator 47. The LED flash period is 0.2 seconds on and 0.2 seconds off. During the pre-monitor phase, the nurse call relay K1 is energized (non-alarming state), nurse call pull-out protection is active, the sensor input is validated, the numeric display 41 continues to display delay time, and the keypad 45 is polled at least 20 times per second. If the software detects an improperly inserted nurse call connector, a tone will be generated, preferably sixteen cycles of 400 Hz followed by 42 msec of silence, repeated four times, followed by a minimum of 320 msec of silence before repeating the entire process. Pressing the delay adjust button 55 will increment the delay time one second up to a maximum of nine seconds. The delay time then resets to one second. The numeric display 41 is updated with each change in the delay time. Pressing the reset button 53 will cause the monitor to immediately proceed to the monitor phase 273. This mode expires after a programmable hold time. The hold time defaults to ten seconds but may be programmed by the user for any time from 1 to 10 seconds. Upon expiration of the hold time or upon pressing the reset button 53, the software advances to the monitor phase 273. The software will return to the hold mode 247 if weight is removed from the mat prior to entering the monitor phase 273.

The monitor phase of the monitor mode 273 is characterized by a solid monitor status indicator 49. During this phase, the sensor is monitored for weight on mat, the nurse call relay K1 is energized (non-alarming state), nurse call pull-out protection is active, the numeric display 41 continues to display the delay time, and the keypad 45 is polled at least 20 times per second. If an improperly inserted nurse call cord is detected, the unit will sound an alarm as described in the pre-monitor phase. Pressing the delay adjust button 55 will advance the delay time one second up to a maximum of nine seconds. The delay time then resets to one second. The numeric display 41 is updated with each change in the delay time. Pressing the reset button 53 will return the software to the hold mode 247, allowing removal of the patient from the bed. Since there must be weight on the mat to be in this mode 247, the hold mode 247 will automatically advance to the pre-monitor phase of the monitor mode 273. To improve functionality, the hold time will temporarily be set to 25 seconds when this path is taken to allow sufficient time to remove the patient from bed. If weight is removed from the mat, the software advances to the pre-alarm phase of the alarm mode 302. Hours in use is logged every 1/10th of an hour.

Figure 14:
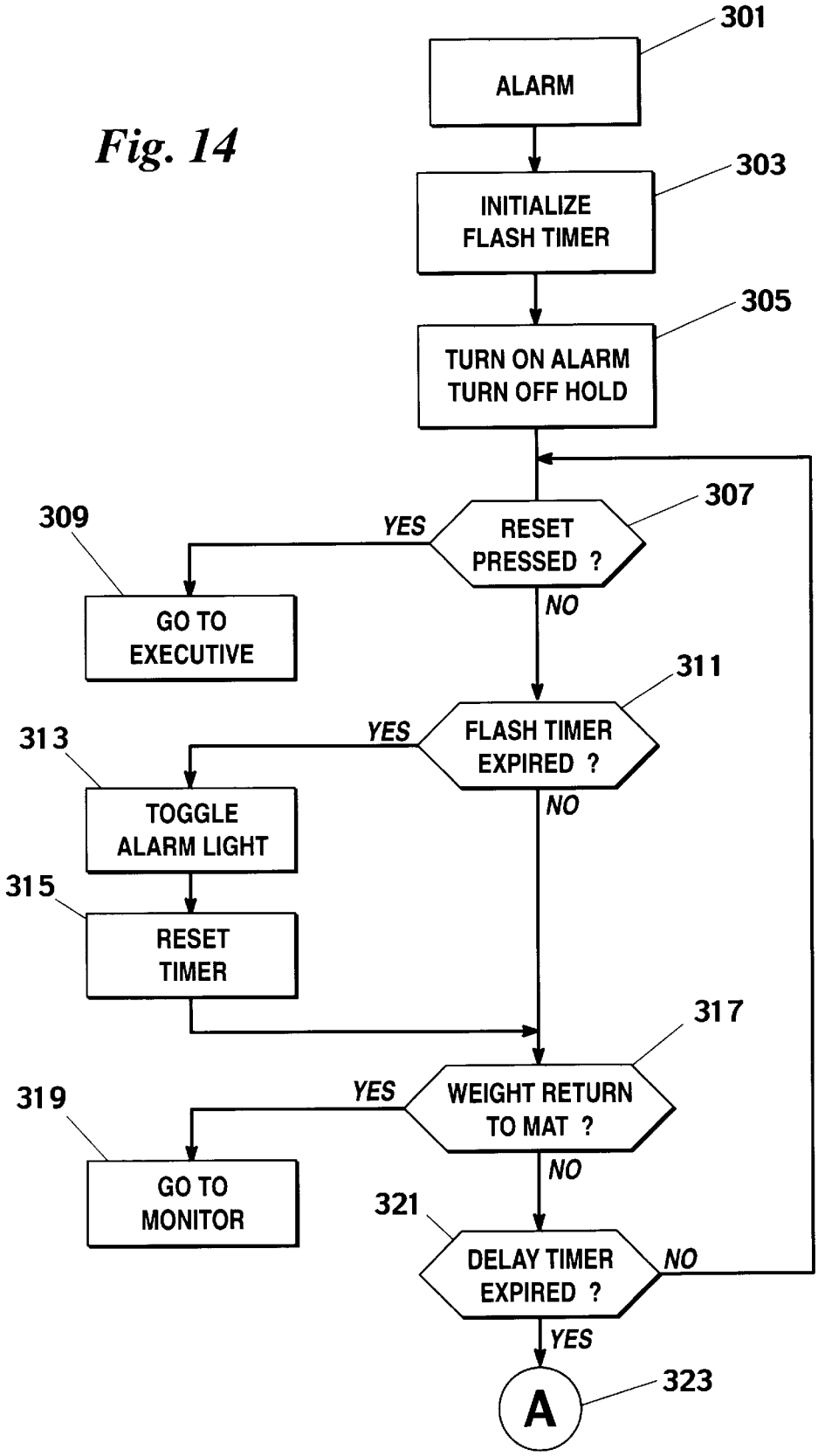
FIG. 14 is a flow diagram illustrating a preferred embodiment of a portion of the alarm mode of the monitor.

The alarm mode 301 illustrated in FIG. 14 consists of a transient re-alarm phase and a steady state alarm phase. The pre-alarm phase is characterized by a flashing alarm indicator 51. The flash period is 0.2 seconds on and 0.2 seconds off. During the pre-alarm phase the nurse call relay K1 is energized (non-alarming state), the mat input is monitored, and the keypad 41 is polled at least 20 times per second. Returning weight to the mat will cause the software to return to the monitor mode 273. Pressing the delay adjust button 55 has no effect. Pressing the reset button 53 will return the software to the hold mode 247. Since this mode 247 is only active with weight off the mat, the monitor will remain in hold upon returning to the hold mode 247. This mode 247 expires after the number of seconds displayed in the numeric display 41 and then enters the alarm phase.

The alarm phase of the alarm mode 301 is characterized by a solid ALARM indicator 51 and an audible alarm. During this mode the nurse call relay K1 is operated in accordance with a pre-programmed protocol and the keypad 41 is polled at least 20 times per second. Pressing the delay adjust button 55 has no effect. The audible alarm will continue to sound until the reset button 53 is pressed, returning the unit to the hold mode 247. The alarm preferably provides one of six possible user selectable alarms including a 1 kHz beep in intervals of 0.5 seconds on and 0.5 seconds off, a 1 kHz beep in intervals of 0.25 seconds on and 0.25 seconds off, a 1 kHz beep in intervals of 1 second on and 1 second off, 16 cycles at 400 Hz followed by 18 cycles at 440 Hz repeated 12 times followed by one second of silence, a rising whoop or a stepped alarm providing four alarms at 320 Hz in intervals of 28 cycles and 28 cycles off, four alarms at 392 Hz in intervals of 32 cycles on and 32 cycles off, four alarms at 277 Hz intervals of 24 cycles on and 24 cycles off with ½ second of silence. It is also possible to have no audible alarm. The nurse call relay K1 has three possible operating modes to accommodate various nurse call systems including continuous closure, one-shot and asynchronous. At the termination of the ALARM mode 301, the response time is written to the EEPROM 101, the stored number of alarms is bumped by one and rewritten to the EEPROM 101 and the current response time is added to the total alarm time and the EEPROM 101 is updated with the new value.

Figure 15:
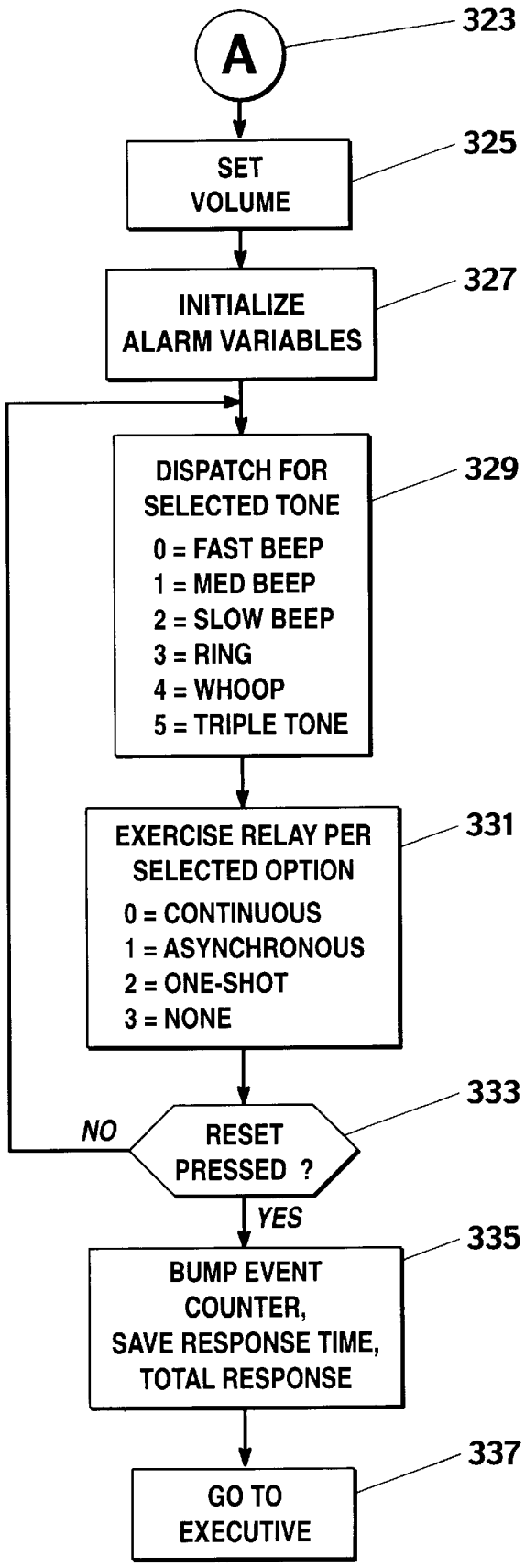
FIG. 15 is a flow diagram of another portion of the alarm mode routine of the monitor.

In the alarm mode 301 the system will initialize flash timer 303 and change the annunciator status to turn on alarm and turn off HOLD 305. The system then inquires as to whether reset is pressed 307 and, if the response to this inquiry is "YES," the system will go to executive 309 and repeat the executive loop 223 illustrated in FIG. 11. If the response to this inquiry is "NO," the system will proceed to inquire as to whether the flash timer has expired 311. If the response to this inquiry is "YES," the system will toggle the alarm light 313 and reset the timer 315. If the response to the flash timer expired inquiry 311 is "NO" or the timer is reset 315, the system will proceed to inquire as to whether there is weight on mat 317. If the response to this inquiry is "YES," the system will go to monitor 319 and repeat the monitor loop 273 illustrated in FIG. 13. If the response to the weight on mat inquiry 317 is "NO," the system will inquire as to whether the delay timer expired 321. In this step, the system determines whether the time selected by the caretaker to elapse after weight has left the mat and before weight has returned to the mat has expired. If the response to this delay time expired inquiry 321 is "NO," the system will return to the reset pressed inquiry 307 of the alarm loop 301. If the response to the delay timer expired inquiry 321 is "YES," the system proceeds to loop A 323 of the alarm mode illustrated in FIG. 15 to provide the audio alarm. In this phase of the alarm mode 301, the system will set the volume 325 and initialize the alarm variables 327 established by the caregiver for the system. The system then dispatches for selected tone 329, causing the monitor to give the audio tone selected from the six audio tones available to the caregiver. The system will also exercise relay per selected option 331, causing the nurse call station relay K1 to function according to one of the four alternatives selected by the caregiver for the system. The system will next inquire as to whether the reset is pressed 333. If the reset button 53 has not been operated by the caregiver, the response to the inquiry is "NO" and the system will return to the dispatch for selected tone 329 step of the alarm loop 301 and continue to provide the selected audio alarm. If the response to the reset press inquiry 333 is "YES," the system will bump event counter, save response time and total response 335 in which the system makes a record of the responses and response times of the caregiver. When this has been completed, the system will go to executive 337 and return to the executive loop 223 illustrated in FIG. 11.

The local configuration or program mode 341 provides the user with a means to select various user options and save these selections in the non-volatile memory 131. To enter this mode 341, the delay time is set to nine seconds. The monitor is then powered down. The monitor then is re-powered up with the reset button 53 pressed. The software will then illuminate multiple annunciators to indicate the particular phase of the programming mode 341 which has been entered. There are four phases of the program mode 341 including tone select, relay action & pull-out detection enable, hold time select and volume adjust. The tone select phase will display the last tone selected in the numeric display 41. A new tone may be chosen by cycling through the available options with the delay adjust button 55. Preferably, the default for the first time to apply power is the 1 kHz beep at 0.5 second intervals mentioned above. The relay action phase will display the current relay action in the numeric display 41. A different action may be chosen by cycling through the available options with the delay adjust button 55. The default for the first time to apply power is continuous operation. The available relay options are discussed above in relation to the alarm mode 301. Programming to a three will disable the pull-out detection. This allows the unit to be used in facilities which do not have a nurse call system or choose not to connect to the nurse call system. Programming this to a zero, one, or two enables the pull-out detection. The hold time phase allows the user to adjust the time delay between a patient placing weight on the mat and the beginning of monitoring. The default is preferably 10 seconds. The user may select 1 to 10 seconds. A zero in the numeric display 41 represents 10 seconds. The volume adjust allows the user to select one of ten possible volume levels. The alarm is silent when set to zero and at full volume when set to nine. The software translates 1 through 9 into actual steps (0–31) of the wiper control VW of the programmable volume control 71. When programmed from the external interface, all 32 steps are available. The default volume is seven (numeric displayed value) which translates to a wiper position of 25. For all of the above, a value is accepted and the next phase is entered by pressing the reset button 53. After the programming of the volume control 71, the monitor enters the hold mode 247. If power is removed during the programming process, the new values up to the last time reset 53 was pressed will be saved.

In the local configuration loop 341, the system will first turn on hold, monitor and alarm lights, load tone selection and output to numeric display 343. The system then proceeds to get keys 345 as earlier discussed with respect to other system loops, inquiring as to whether the delay adjust is pressed 347. If the response to this inquiry is "YES," the system will increment the toning selection 349 and then inquire as to whether the tone is greater than five 351. This relates to the sequence of six tones earlier referenced in relation to the alarm mode 301. If the response to this inquiry 351 is "YES," the system will reset the alarm mode to zero 353. If, after incrementing tone selection 349 the tone is not greater than five 351 or is set to zero 353, the system returns to the turn-on hold, monitor and alarm lights, load current tone selection and output numeric display step 343. If the response to the delay adjust pressed inquiry 347 is "NO," the system next inquires as to whether the reset is pressed 355.

Figure 17:
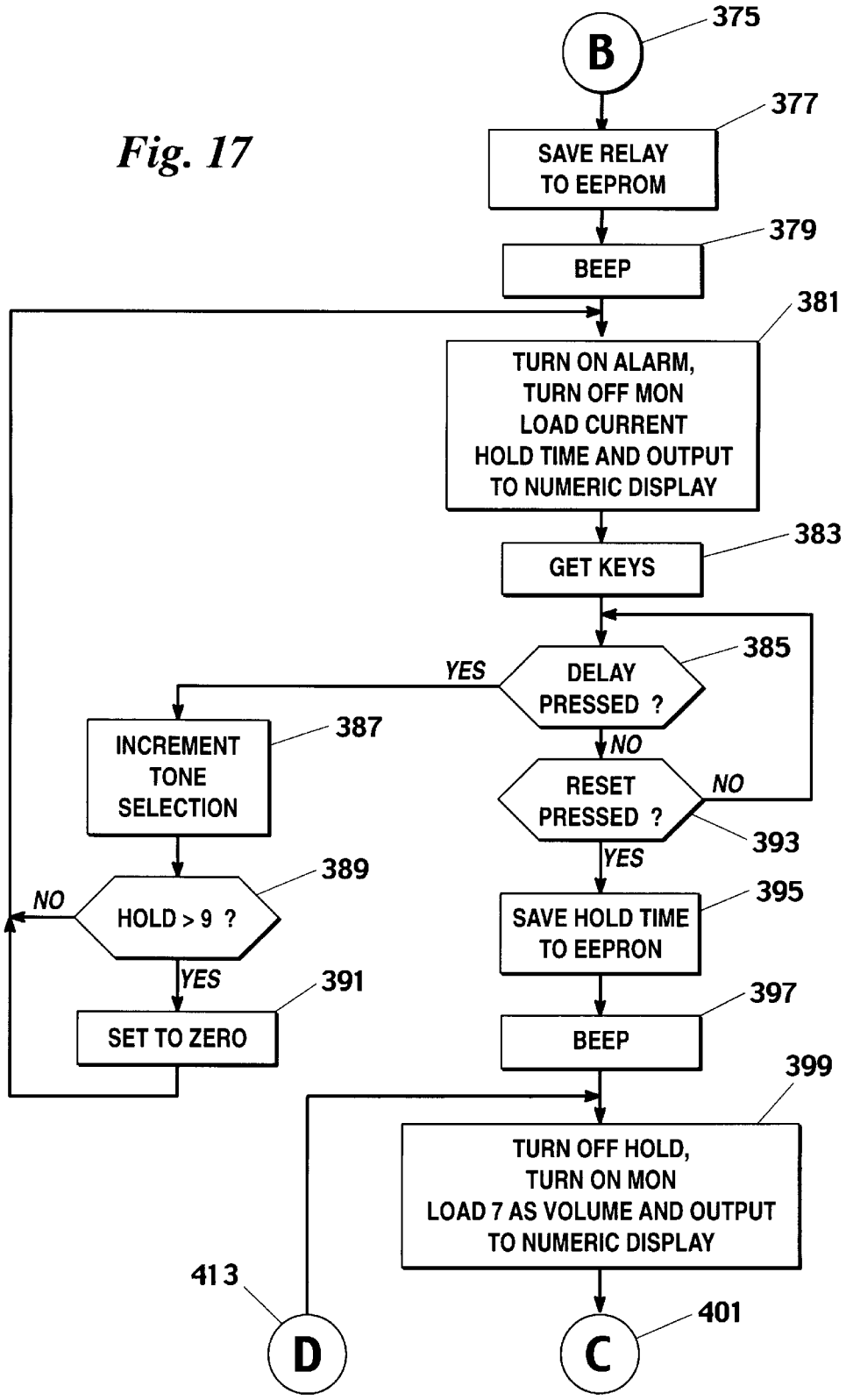
FIG. 17 is a flow diagram illustrating a portion of a preferred embodiment of the program mode of the monitor.
Figure 18:
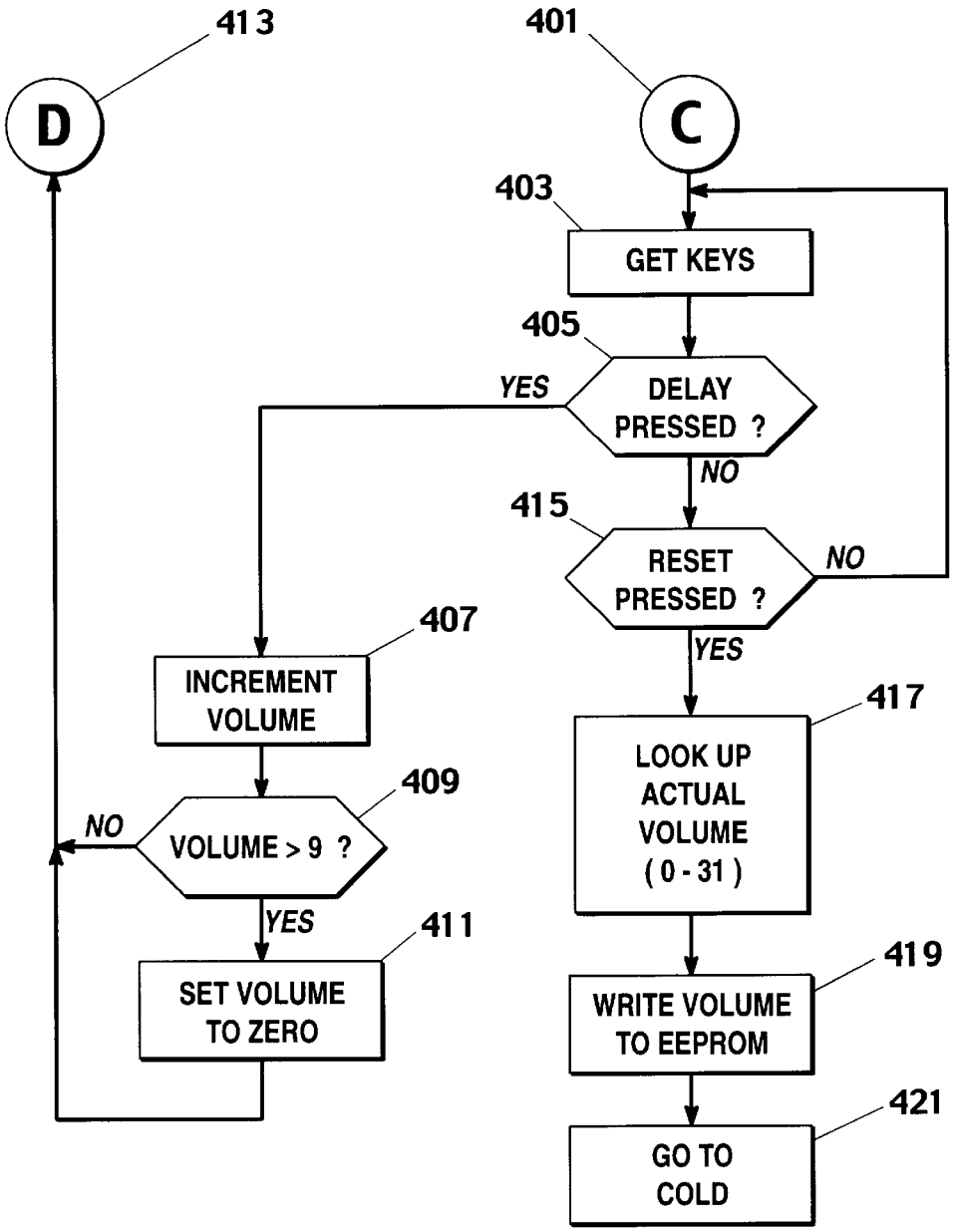
FIG. 18 is a flow diagram illustrating a portion of a preferred embodiment of the program mode of the monitor.

If the answer to this inquiry 349 is "NO," the system returns to the get keys step 345. If the response to this inquiry 349 is "YES," the system will save tone to EEPROM 357. When the tone has been saved in EEPROM 101, the system will beep 359 to indicate this status. The system will then turn off alarm light, load current relay action and output to numeric display 361 and again proceed to get keys 363. The system again inquires as to whether the delay adjust is pressed 365. If the response to this inquiry 365 is "YES," the system will increment relay action 367 according to the sequence discussed in relation to the alarm mode 301. The system will inquire as to whether the relay is greater than three 369, determining which increment of the relay options the system will select. If the response to this inquiry 369 is "YES," indicating that the option will be greater than three, the system sets to zero 371 to begin a recycle of available selections. If the answer to the inquiry 369 is "NO" or if the selection is set to zero 371, the system returns to the turn off alarm light, load current relay action and output to numeric display step 361. If the response to the delay adjust pressed inquiry 365 is "NO" the system proceeds to inquire as to whether the reset is pressed 373. If the answer to this inquiry is "NO," the system returns to the get keys step 363. If the answer to this inquiry is "YES," the system proceeds to point B 375 of FIGS. 16 and 17. Looking at FIG. 17, if the reset pressed inquiry 373 response is "YES," the system will save relay to EEPROM 377, storing the selected relay position in the EEPROM 101. The system then proceeds to beep 379 to advise the care giver of the status. The system then turns on the alarm annunciator, turns off the monitor annunciator, loads the current hold time and outputs to numeric display 381. The system then again proceeds to get keys 383, first inquiring as to whether the delay adjust is pressed 385. If the response to this inquiry is "YES," the system will increment hold time 387. Inquiry is made as to whether the hold is greater than nine 389 and if the response to this inquiry is "YES," the system will set to zero 391. If the response to the inquiry 389 is "NO," or the system has been set to zero 391, the system will return to the turn-on alarm annunciator, turn-off monitor annunciator, load current hold time and output numeric display 381. If the response to the delay adjust pressed inquiry 385 is "NO," the system will then inquire as to whether the reset is pressed 393. If the response to this inquiry is "NO," the system returns to the delay adjust pressed inquiry 385. If the response to the inquiry 393 is "YES," the system will save hold time to EEPROM 395, storing the selected delay time in the EEPROM 101. The system will then provide a beep 397 to indicate the status and will then turn off the HOLD annunciator, turn on monitor annunciator, load 7 as the volume and output to the numeric display 399. That is, of the ten volume increments selectable, the system will automatically proceed to the seventh increment level. The system then proceeds through point C 401 as illustrated in FIG. 18 to get keys 403 and inquire as to whether the delay adjust is pressed 405. If the response to this inquiry 405 is "YES," the system will increment volume 407 and inquire whether the volume is greater than nine 409. If the response to this inquiry 409 is "YES," the system will reset volume to zero 411. If the response to the volume greater than nine 409 is "NO," or the system has set the volume to zero 411, the system then returns through point D 413 to turn-off HOLD annunciator, turn-on monitor annunciator, load 7 as volume and output to numeric display 399 as shown in FIG. 17. Returning to FIG. 18, if the response to the delay adjust pressed inquiry 405 is "NO," the system proceeds to inquire as to whether the reset is pressed 415. If the response to this inquiry 415 is "NO," the system returns to the get key step 403. If the response to the inquiry 415 is "YES," the system proceeds to look up actual volume 417. The system then writes the volume to EEPROM 419, storing the selected volume in the EEPROM 101, and then goes to cold 421, returning to the cold start 201 illustrated in FIG. 10.

Figure 19:
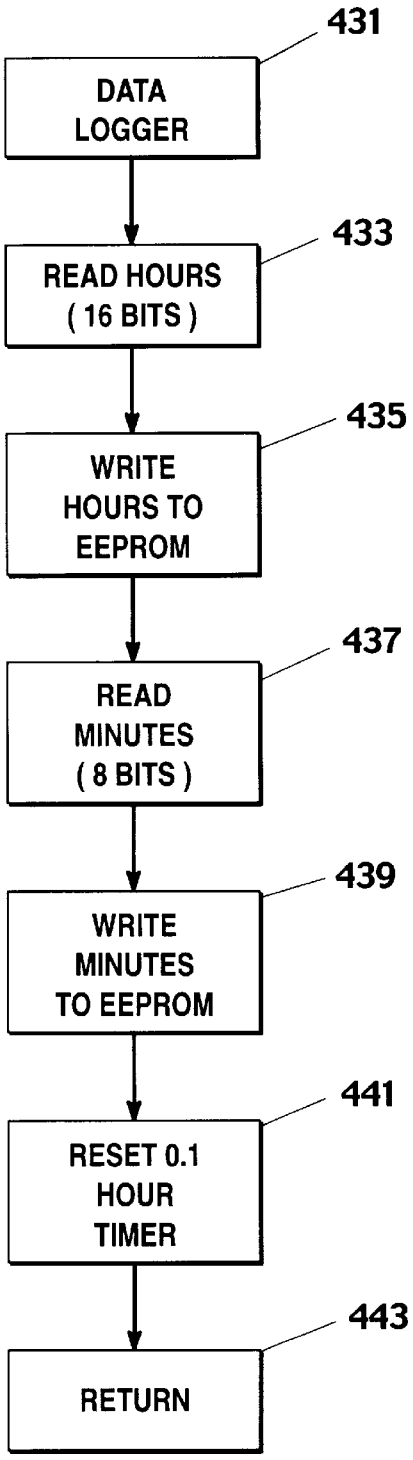
FIG. 19 is a flow diagram illustrating a preferred embodiment of the data logger subroutine of the monitor.

The data logger subroutine 431 illustrated in FIG. 19 is used by the system at the call data logger steps 239 and 279 of the executive loop 223 illustrated in FIG. 11 and the monitor mode 273 illustrated in FIG. 13, respectively. In the data logger sub routine 431, the system will read hours from RAM 433 and write hours to EEPROM 435, storing the number of hours that the system has operated in EEPROM 101. The system will then read minutes from RAM 437 and write minutes to EEPROM 439 to store any portion of an hour not already stored in EEPROM 101. The system will then reset 0.1 hour timer 441 and return 443 to the routine making the data logger demand.

Figure 20:
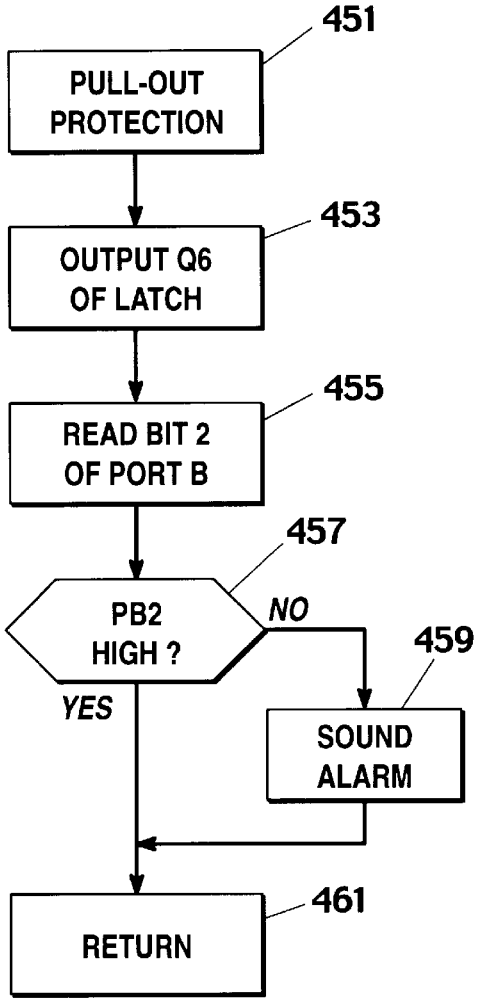
FIG. 20 is a flow diagram illustrating a preferred embodiment of the pull-out protection subroutine of the monitor.

The pull-out protection sub routine 451 illustrated in FIG. 20 is used by the system at the call pull-out steps 269 and 291 of the hold delay mode 247 illustrated in FIG. 12 and the monitor mode 273 illustrated in FIG. 13, respectively. In the pull-out protection subroutine 451, the system will read the output $Q_6$ of the latch and read the status of Bit 2 of Port B 455. The system will then inquire as to whether PB2 is high 457. If the response to this inquiry is "NO," the system will sound alarm 459 and return 461 to the pull-out protection step 451. If the response to this inquiry is "YES," the system will proceed to return 461 to the routine making the pullout protection demand without sounding the alarm.

The monitor will preferably conform to the following specifications:

| Spec | Min: | Max: | Units | Tolerance |
|---|---|---|---|---|
| Delay Time | 1 | 10 | seconds | +/−5% |
| Hold Time | 1 | 10 | seconds | +/−5% |
| Relay One-shot Duration | 0.5 | 5 | seconds | n/a |
| Relay Asynchronous On | .25 | 2 | seconds | n/a |
| Relay Asynchronous Off | .25 | 2 | seconds | n/a |
| Tone Programming | 0 | 7 | n/a | n/a |
| Relay Programming | 0 | 2 | n/a | n/a |
| Pull-out Programming | 0 | 1 | n/a | n/a |
| Hold Time Programming | 0 | 9 | n/a | n/a |
| Warning Frequencies | n/a | n/a | Hertz | +/−10% |
| Tone Durations | n/a | n/a | seconds | +/−10% |

Thus, it is apparent that there has been provided, in accordance with the invention, a monitor and method of operation of the monitor that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A bed patient monitor comprising:

loudspeaker, said loudspeaker being driven by a power amplifier and said amplifier responding to an input signal derived from a programmable volume control to produce an aural alarm; and a processor for receiving electronic signals from a sensor indicative of the presence thereon and absence therefrom of a patient, for synthesizing at least one alarm sound under software control, for operating said programmable volume control to select a decibel level of said at least one alarm sound and for activating and deactivating said alarm in response to said electronic signals.

2. A monitor according to claim 1 further comprising electrically erasable programmable read only memory for storing a plurality of alarm sounds for selection by said processor of said at least one alarm sound.

3. A monitor according to claim 1 further comprising electrically erasable programmable read only memory for storing a plurality of decibel levels for selection by said processor of said decibel level of said at least one alarm sound.

4. A monitor according to claim 1 further comprising electrically erasable programmable read only memory for storing a plurality of options for a delay time between an initiation of absence of a patient from the sensor and an activation of said alarm by said processor.

5. A monitor according to claim 4 further comprising an external switch connected to said processor for selecting said delay time from said plurality of options.

6. A monitor according to claim 1 further comprising electrically erasable programmable read only memory for logging usage data including total hours of use of the monitor, total time of alarm sounding by the monitor, total number of alarms sounded by the monitor and a response time between a most recent sounding of an alarm and a subsequent operation of the monitor.

7. A monitor according to claim 6 having a port for downloading said logged usage data to a host computer.

8. A monitor according to claim 1 further comprising a nurse call interface having a relay which is energized when said power amplifier is deenergized and having a normally open contact, a normally closed contact and a common contact for interconnecting the monitor to a nurse call system through one of said normally open and normally closed contacts.

9. A bed patient monitor comprising:

a loudspeaker, said loudspeaker being driven by a power amplifier and said amplifier responding to an input signal derived from a programmable volume control to produce an aural alarm;

a processor for receiving electronic signals from a sensor indicative of the presence thereon and absence therefrom of a patient, for synthesizing at least one alarm sound under software control, for operating said programmable volume control to select a decibel level of said at least one alarm sound and for activating and deactivating said alarm in response to said electronic signals; and, electrically erasable programmable read only memory for logging usage data including total hours of use of the monitor, total time of alarm sounding by the monitor, total number of alarms sounded by the monitor and a response time between a most recent sounding of an alarm and a subsequent operation of the monitor.

10. A monitor according to claim 9 having a port for downloading said logged usage data to a host computer.

* * * * *